US012796843B2

(12) United States Patent
Stewich

(10) Patent No.: US 12,796,843 B2
(45) Date of Patent: Nov. 17, 2026

(54) ADJUSTABLE SCREEN SYSTEM FOR A WORK SURFACE

(71) Applicant: Haworth, Inc., Holland, MI (US)

(72) Inventor: William C. Stewich, West Bylston, MA (US)

(73) Assignee: Haworth, Inc., Holland, MI (US)

( * ) Notice: Subject to any disclaimer, the term of this patent is extended or adjusted under 35 U.S.C. 154(b) by 654 days.

(21) Appl. No.: 18/121,307

(22) Filed: Mar. 14, 2023

(65) Prior Publication Data

US 2024/0306827 A1 Sep. 19, 2024

(51) Int. Cl.

| | |
|---|---|
| ***A47G 5/00*** | (2006.01) |
| ***A47B 97/00*** | (2006.01) |
| *A47B 97/02* | (2006.01) |
| *A47B 97/08* | (2006.01) |

(52) U.S. Cl.

CPC ..... *A47G 5/00* (2013.01); *A47B 97/00* (2013.01); *A47B 97/02* (2013.01); *A47B 97/08* (2013.01); *A47B 2200/0085* (2013.01); *A47B 2200/12* (2013.01)

(58) Field of Classification Search

CPC ..... A47B 97/02; A47B 97/08; A47B 97/00; A47B 2200/0085; A47B 2200/12; A47G 5/00

See application file for complete search history.

(56) References Cited

U.S. PATENT DOCUMENTS 1,891,002 A * 12/1932 McCombie ..... A47G 5/00 160/40
2,047,085 A * 7/1936 Speer ..... A47G 5/00 160/152
2,525,683 A * 10/1950 Keely ..... A47G 5/00 D25/58
2,571,382 A * 10/1951 Raven ..... G03B 21/58 160/351
3,125,155 A * 3/1964 Frommelt ..... A47G 5/00 160/230
3,540,787 A * 11/1970 Ford ..... A47B 97/08 312/231
4,085,789 A * 4/1978 Steiner ..... A47G 5/00 160/351

(Continued)

FOREIGN PATENT DOCUMENTS

CH 668355 A5 * 12/1988 ..... D06F 95/004
CH 709815 A2 * 12/2015 ..... A47B 3/10

(Continued)

*Primary Examiner* — Phi D A
*Assistant Examiner* — Phi D Tran
(74) *Attorney, Agent, or Firm* — Warner Norcross + Judd LLP

(57) ABSTRACT

A screen system for use with an article of furniture includes a screen and a rail. The screen has a degree of flexibility in the direction of the screen thickness. The screen includes a plurality of attachment hooks projecting from the interior surface, the attachment hooks are spaced apart along the screen length. The rail is configured to be affixed to the article of furniture, and the attachment hooks hook onto the rail to support the screen on the rail, with the attachment hooks being slidable along the rail to enable adjustment of the position of the screen along the rail in the direction of the screen length.

9 Claims, 24 Drawing Sheets

(56) References Cited

U.S. PATENT DOCUMENTS

| | | | | | |
|---|---|---|---|---|---|
| 4,842,035 | A * | 6/1989 | Thompson | E04B 2/7431 | 160/351 |
| 6,206,079 | B1 * | 3/2001 | Selgrad | G09F 15/00 | 160/351 |
| 6,293,328 | B1 * | 9/2001 | Fremont | A47G 5/00 | 52/36.4 |
| 7,530,543 | B1 * | 5/2009 | Kremzar | A47B 97/02 | 248/188.7 |
| 2002/0062933 | A1 * | 5/2002 | Insalaco | A47G 5/00 | 160/351 |
| 2013/0255895 | A1 * | 10/2013 | Toledo | F16B 12/42 | 160/382 |

FOREIGN PATENT DOCUMENTS

| | | | | | |
|---|---|---|---|---|---|
| DE | 20002165 | U1 * | 5/2000 | A47B 97/08 | |
| DE | 102008060474 | A1 * | 6/2010 | A47B 97/02 | |
| GB | 147992 | A * | 7/1920 | A47G 5/00 | |
| GB | 2537667 | A * | 10/2016 | A47G 5/00 | |

* cited by examiner

ADJUSTABLE SCREEN SYSTEM FOR A WORK SURFACE

The present invention relates to a screen system, and more particularly to a physical barrier such as a privacy screen or door that is adjustably mounted to an article of furniture.

While open collaboration remains a vital part of the office environment, there is also a need to provide work spaces with a degree of privacy and physical separation between users, and to dynamically adapt open style work spaces in such a way that they can provide a degree of privacy and physical separation when desired. Freestanding screens or wall panels have long been used for dividing large, open floor spaces into smaller work spaces, and privacy screens can provide a degree of privacy and separation to an individual workstation, table, desk, and/or work surface. Privacy screens generally provide a physical, visible barrier to selected areas above a work surface, while modesty screens generally provide a visible barrier to an area below the work surface. Each of these screen type systems are typically mounted to a desk or article of furniture in a manner that requires disassembly or removal of a series of fasteners or other attachments in order to reconfigure the positioning of the screen.

SUMMARY OF THE INVENTION

The present invention provides an easily installable and adjustable screen system for use in a wide variety of work settings. The screen system may be configured for use with an article of furniture, such as a privacy screen for a work surface, or a door for a bookcase or credenza.

The screen system generally includes a screen and a rail. The screen may have a degree of flexibility in the direction of the screen thickness to enable the screen to be adjusted along a curved rail. The screen includes a plurality of attachment hooks projecting from the interior surface, and the plurality of attachment hooks are spaced apart along the screen length. The rail is configured to be affixed to the article of furniture, and the rail has at least one of an upper rail edge and a lower rail edge. In one embodiment, the attachment hooks engage the rail to support the screen on the rail, and the attachment hooks are slidable along the rail to enable adjustment of the position of the screen along the rail in the direction of the screen length.

In one embodiment, the screen defines a plurality of openings extending through the screen thickness. The openings are spaced apart along the screen length, and the attachment hooks are formed separately from the screen, and each attachment hook is inserted through a corresponding one of the openings. Each attachment hook may include a base, and a hook projecting from the base, and at least one dimension of the base may greater than at least one dimension of the corresponding opening such that the base is prevented from being inserted completely through the opening and the base retains the attachment hook in the corresponding opening. At least one of the attachment hooks may include a pair of the hooks extending from the base, the pair of hooks and the base forming a C-shape, and one of the pair of hooks may engage the upper rail edge and the other of the pair of hooks may engage the lower rail edge.

In one embodiment, the rail is mounted to a worksurface, and the screen is a privacy screen. The rail may extend around the corner of a worksurface, with the privacy screen slidably mounted to the rail between the lateral ends of the rail, and with the hook portion of each attachment hook engaging at least one of the upper rail edge and the lower rail edge as the screen is slid along the rail, wherein the position of the privacy screen is selectively adjustable toward one of the lateral ends of the rail by sliding the privacy screen along the rail with the hooks remaining engaged with, and sliding along, the upper rail edge or the lower rail edge, wherein the flexibility of the screen enables sliding of the screen along the rail around the corner of the work surface.

In one embodiment, both the screen and the attachment hooks are formed from a PET material. In another embodiment, the plurality of openings are positioned closer to one of the upper edge and the lower edge of the screen, such that the screen can be attached to the rail in a first orientation to be used as a privacy screen, or in a second orientation to be used as a modesty panel. The rail may include an attachment portion for attaching the rail to the perimeter edge of a worksurface or other article of furniture, and in one embodiment, the rail includes an inner rail portion and an outer rail portion, such that the screen can engage and slide along the outer rail portion while the inner rail portion can receive and support accessories such as trays and cup holders without interference from the sliding screen.

In another embodiment, the screen can function as a cover or a door for an internal cavity for an article of furniture such as a bookcase, credenza, cabinet or the like. The article of furniture may include a perimeter edge, and the rail may be attached to the perimeter edge or adjacent to the perimeter edge. The perimeter edge may define an opening for an internal cavity of the article of furniture, and the screen may be movable along the rail between a first position in which the screen covers the opening to the internal cavity and a second position in which the screen does not cover at least a portion of the opening to provide access to the internal cavity. The perimeter edge may include an upper portion and a lower portion, and the rail may include an upper rail portion extending along the upper portion of the perimeter edge, and a lower rail portion extending along the lower portion of the perimeter edge. The attachment hooks may include an upper series of attachment hooks engaging the upper rail portion and a lower series of attachment hooks engaging the lower rail portion. In one embodiment, the upper rail portion has an upper rail edge, and the lower rail portion has a lower rail edge. The upper series of attachment hooks engage the upper rail edge of the upper rail portion, and the lower series of attachment hooks engage the lower rail edge of the lower rail portion.

These and other objects, advantages, and features of the disclosure will be more fully understood and appreciated by reference to the description of the current embodiment and the drawings.

Before the embodiments of the disclosure are explained in detail, it is to be understood that the disclosure is not limited to the details of operation or to the details of construction and the arrangement of the components set forth in the following description or illustrated in the drawings. The disclosure may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the disclosure any additional steps or components that might be combined with or into the enumerated steps or components.

DESCRIPTION OF THE EMBODIMENT(S)

Figure 1:
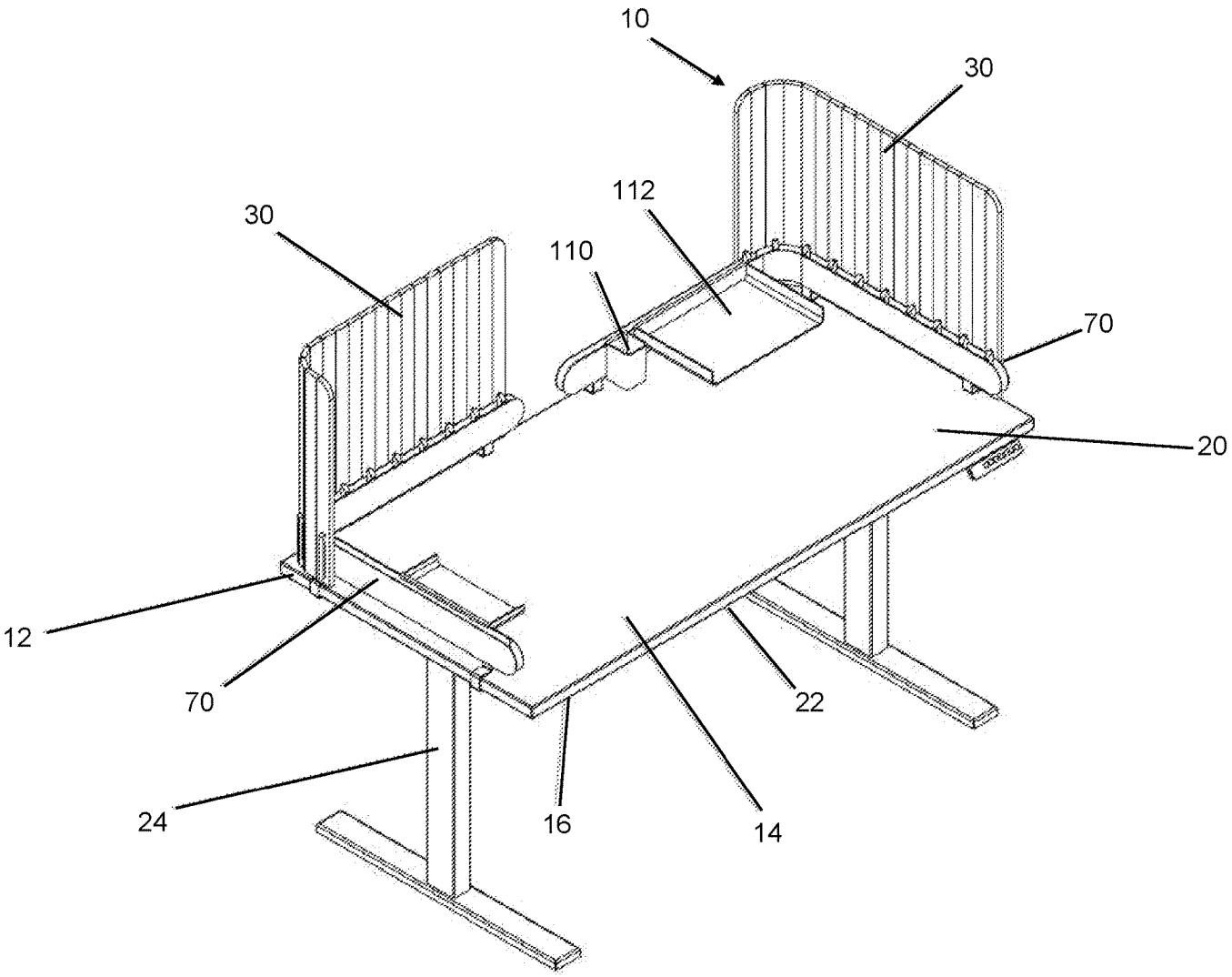
FIG. 1 is a perspective view of a workstation including a screen system according to an embodiment.

An adjustable screen system 10 that can be selectively positioned and adjusted for providing a visibility barrier, panel, door, or other slidable covering is disclosed herein. In embodiments shown in FIG. 1-22, the screen system functions as a privacy screen system for use with a traditional workstation, desk, table, or other article of furniture and may be easily installed, positioned and repositioned relative to the work surface as desired. The privacy screen can provide a desired degree of privacy and separation, with adjustability in the position of the screen along a perimeter of the work surface for which the privacy screen provides a barrier, as well as providing a visibility barrier above and/or below the work surface. The privacy screen can be positioned to provide a more private, separated and personal work space that might be needed for individual work, or can be easily adjusted by a user to provide a more open work space and facilitate group collaboration and communication.

Throughout this description, directional terms, such as "vertical," "horizontal," "top," "bottom," "upper," "lower," "inner," "inwardly," "outer" and "outwardly," may be used to assist in describing the structure based on the orientation of the embodiments shown in the illustrations. The use of directional terms should not be interpreted to limit the structure to any specific orientation(s).

Referring to FIGS. 1-9, the screen system 10 is configured for use with a workstation 12 that includes a work surface 14, countertop, desktop, tabletop, or other surface or article of furniture. In the illustrated embodiment, the work surface 14 defines a perimeter 16, an upper surface 20, and a lower surface 22. As shown in this embodiment, the work surface 14 is generally rectangular; however, other suitable work surface shapes are contemplated, including square, circular, and oval shapes. Optionally, the workstation 12 may include a base configured to support the workstation 12 on a floor surface and height adjustable pedestal(s) 24 to enable the work surface 14 to be raised and lowered as desired. Further optionally, the work surface 14 may be rotatable, in a substantially horizontal plane, relative to the pedestal 24. Further still, the workstation 12 may include wheels and a variety of accessories mounted to the base and/or the pedestal(s) 24.

Figure 4:
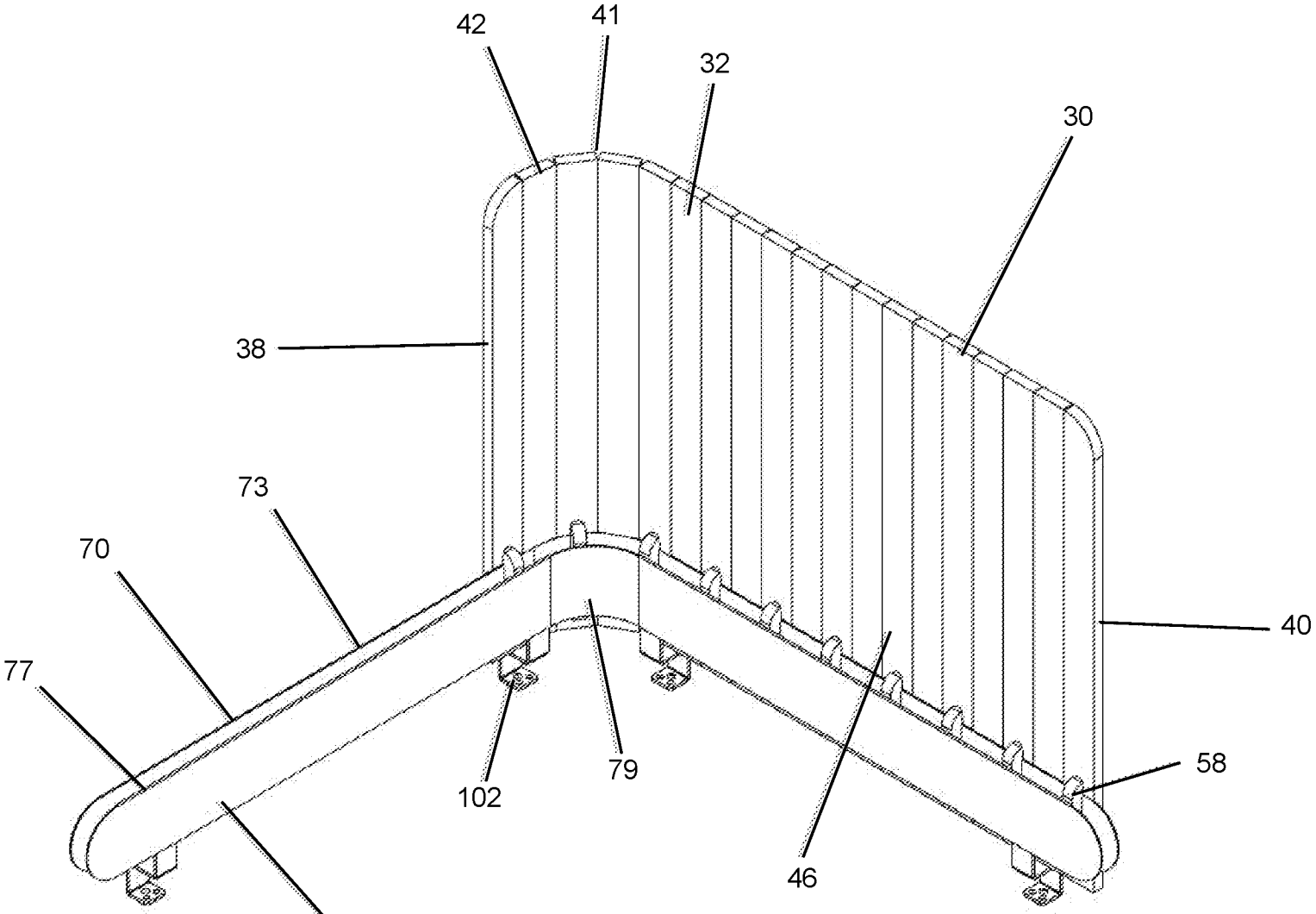
FIG. 4 is a perspective view of a screen and rail according to one embodiment.

The screen system 10 generally includes a screen 30 and a rail 70. In the embodiments of FIGS. 1-22, each worksurface 14 is illustrated with two separate screen systems 10, positioned on opposite sides of the worksurface 14. These screen systems 10 are generally mirror images of each other, and features of each system 10 are referenced interchangeably. With reference to FIG. 4, the screen 30 has a main body 32 which defines a left edge 38, a right edge 40, a top edge 42, a bottom edge 44, an interior face 46, and an exterior face 48. A screen height is measured between the top and bottom edges 42, 44, a screen length is measured between the left and right edges 38, 40, and a screen thickness is measured between the interior 46 and exterior 48 faces. As illustrated and described, the interior face 46 faces toward the work surface 14 when the privacy screen system 10 is mounted to the work surface 14, and the exterior face 48 is the opposite surface, facing away from the work surface 14. The main body 32 may be made of foam, polyethylene terephthalate (PET) substrate, or other suitable substrate or composite material and may also include a fabric covering, other type of covering, or no covering at all. In one embodiment, the interior 46 and exterior 48 faces are interchangeable, such that the screen 30 can alternatively be attached to the rail with the exterior face 48 facing the work surface 14.

The main body 32 can be configured to provide structure in the height direction (generally the vertical direction) and to bend or flex in the thickness direction (generally the horizontal direction) so that the screen 30 is able to follow corners or to otherwise conform to a curved portion, corner portion, or otherwise non-planar portion of a rail 70 and a work surface perimeter 16. The main body 32 can include a pattern of parallel vertical hinges, or flex lines 41, which may be lines of reduced thickness 41 of the main body 32 that enable the screen to flex. As shown, the flex lines 41 are evenly spaced apart along the length of the screen 30. In another embodiment, the flex lines 41 may be spaced in a different pattern. The spacing between the flex lines 41 may control the degree of flexibility in the screen 30, with a smaller distance between flex lines 41 creating a more flexible screen 30 or section of the screen 30, and with a greater distance between the flex lines 41 creating a less flexible section of the screen 30.

Figure 7:
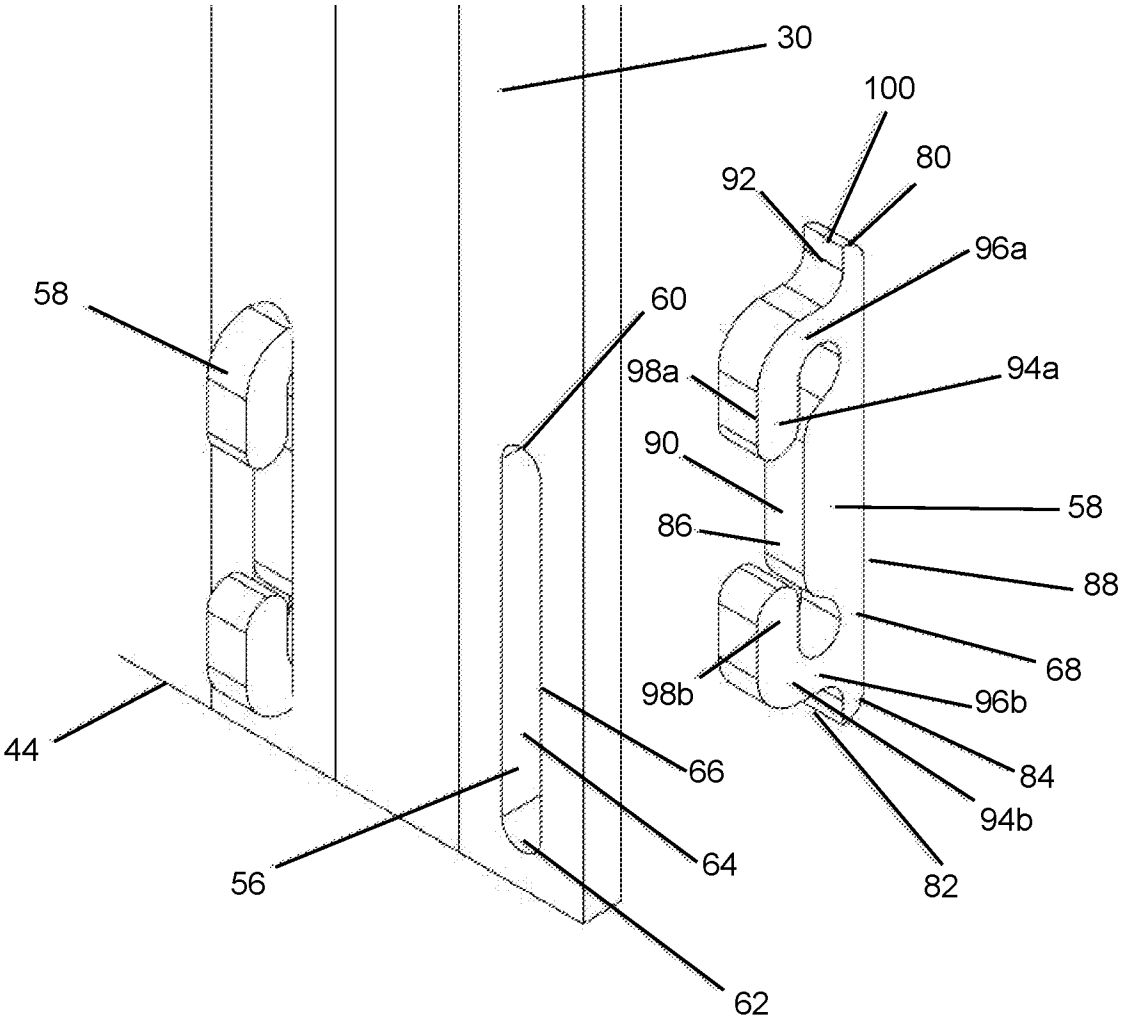
FIG. 7 is an exploded view of a screen and an attachment hook.
Figure 8:
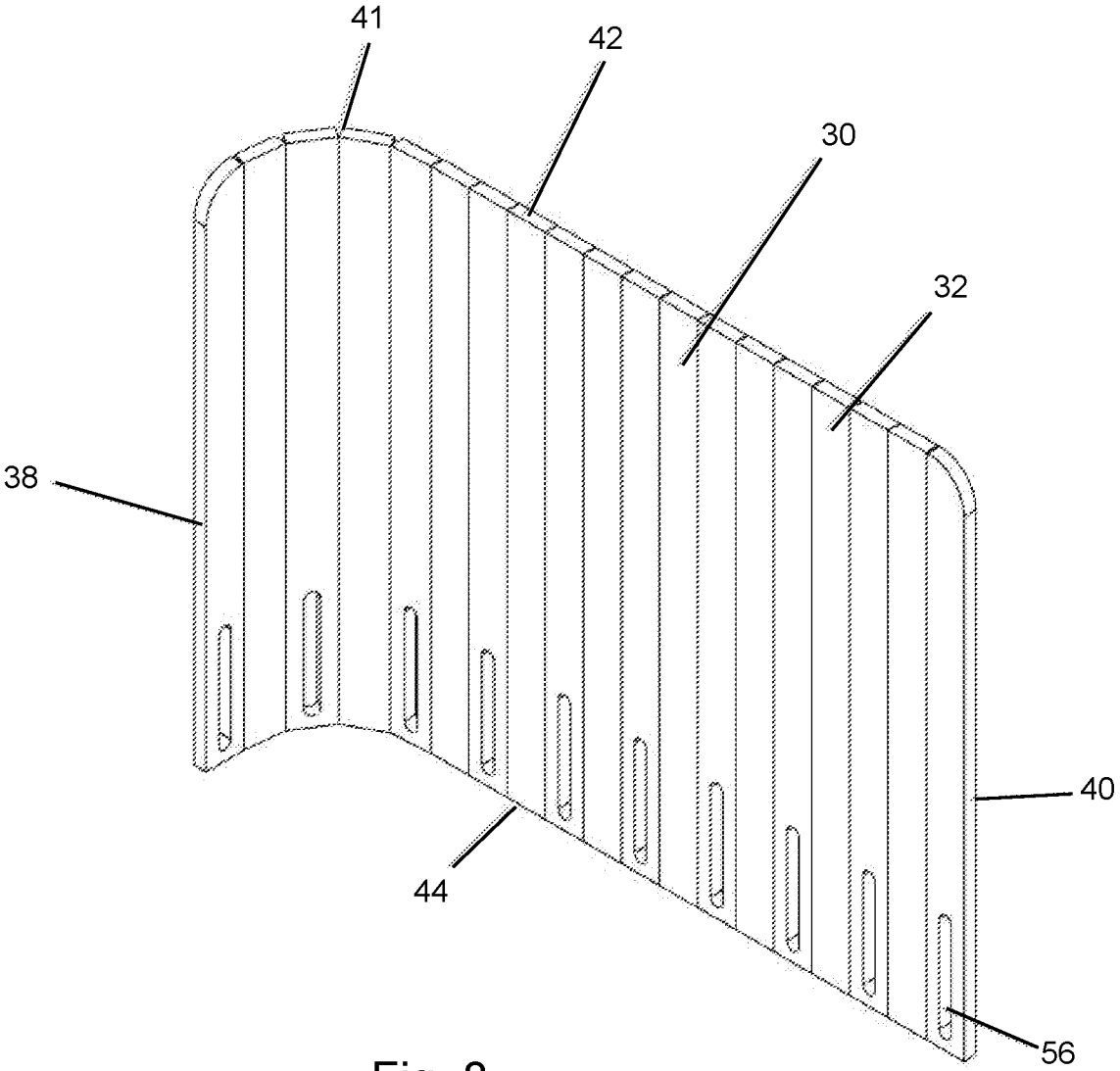
FIG. 8 is a perspective view of a scree with attachment hooks removed.

Referring to FIGS. 7 and 8, in one embodiment the screen 30 defines a series of openings 56 extending through the thickness of the screen 30 and through the interior and exterior surfaces 46, 48. As described in more detail below, the openings 56 form receptacles for attachment hooks 58 that are inserted through the openings 56 and function to retain the screen 30 on the rail 70 in a slidable manner. In one embodiment, the openings 56 are slots that extend generally in the direction of the screen height, with each opening 56 having an upper end 60, a lower end 62, and parallel sidewalls 64, 66 extending between the upper end 60 and the lower end 62 such that the openings 56 each have a slot height defined between the upper end 60 and the lower end 62 that is greater than the slot width defined between the sidewalls 64, 66. As illustrated, the slot height is greater than the slot width. In one embodiment, the openings 56 are generally evenly spaced along the length of the screen 30, and are each spaced evenly between a paid of the flex lines 41.

As shown, the openings 56 uniform in their size and positioning, and are positioned in a single line along the length of the screen 30 adjacent to the bottom edge 44 of the screen 30. In another embodiment, the openings 56 may be varied in their size, shape and positioning, with some openings being larger than other openings, and at different positions along the height of the screen. In one embodiment, the openings 56 may include a first series of openings that extend adjacent to the lower edge 44 of the screen, and a second series of openings that extend adjacent to the top edge 42, for embodiments where the screen 30 is adapted to engage upper and lower rails.

The screen 30 further includes attachment hooks 58 for slidably attaching the screen 30 to the rail 70. Referring to FIG. 7, in one embodiment, the attachment hooks 58 are formed separately from the screen 30, and designed to be inserted into the openings 56. As illustrated, each attachment hook 58 includes a base 68 and a pair of hooks 94 extending from the base 68. The base 68 has upper and lower ends 80, 82, opposing sidewalls 84, a front surface 86, and a rear surface 88. The base 68 defines an attachment hook width between the sidewalls 84, and as illustrated the attachment hook width is generally the same as the slot width of the openings 56 to fit snugly within the openings 56 when the attachment hooks 58 are inserted into the openings 56. In the illustrated embodiment, the front surface 86 includes a hill 90 in a central region and valleys 92 on opposite sides of the hill 90 and adjacent to the upper 80 and lower 82 ends respectively.

The screen 30 includes at least one hook 94 extending outwardly from the front surface 86 of the base 68. With reference to FIG. 7, each hook 94 is generally L-shaped, and includes a first leg 96 projecting from the front surface 86 of the base 68 at about a 90 degree angle from the front surface 86, and a second leg 98 projecting at an angle from the first leg 96. The first leg 96 is positioned within a valley 92 of the base 68, and is near one of the upper and lower ends 80, 82, but not immediately adjacent to the one of the upper and lower ends 80, 82 such that a retention tab portion 100 extends beyond the first leg 96. In the illustrated embodiment, the screen 30 includes a pair of the hooks 94, with a first hook 94*a* positioned near the upper end 80 of the base 68 with a first retention tab 100*a* between the first hook 94*a* and the upper end 80, and with a second hook 94*b* positioned near the lower end 82 with a second retention tab 100*b* between the second hook 94*b* and the lower end 82. In the illustrated embodiment, the second leg 98*a* of the first hook 94*a* faces inwardly, toward the second leg 94*b*, and the second leg 98*b* of the second hook 94*b* faces inwardly, toward the first hook 94*a*. The attachment hooks 58 of the illustrated embodiment this form a generally C-shape between the base 68 and the first and second hooks 94*a*, 94*b*.

The size and shape of the attachment hooks 58 may be predetermined to correspond to the size of the rail 70 (with the rail 70 described in more detail below). In one embodiment, the spacing between the hooks 94*a*, 94*b* is directly related to the size of the rail 70. More particularly, the first leg 96*a* of the first hook 94*a* is spaced from the first leg 96*b* of the second hook 94*b* by about the distance between the upper and lower rail edges 73, 75 as described in more detail below. In addition, the length of the first legs 96*a*, 96*b* and the distance between the first legs 96*a*, 96*b* and the front surface 86 of the base 68 relates to the size of the rail 70. More particularly, the distance between the first legs 96*a*, 96*b*, and the front surface of the rail 70 within the hill region 90 is about the same as the thickness of the rail 70 (i.e., the distance between the interior face 72 and the exterior face 74 of the rail 70 as described in more detail below. The attachment hooks 58 may each be formed as a unitary piece, and may be made from a variety of materials, similar to that of the main body 32 of the screen 30. In one embodiment, the attachment hooks 58 are made from the same PET material as the main body 32 of the screen 30, such that the attachment hooks 58 match the material of the main body 32.

The size and shape of the attachment hooks 58 may also be predetermined to correspond to the size and shape of the openings 56 in the screen 30. For example, the attachment hooks 58 and the screen openings 56 are designed such that each of the attachment hooks 58 can be inserted into one of the openings 56 by inserting the hooks 94 through the opening 56 until the hooks 94 project outwardly from the interior surface 46 of the main body 32 with a portion of the attachment hook 58 preventing the attachment hook 58 from being pulled completely through the opening 56. In the illustrated embodiment, this is accomplished by sizing the height of the attachment hook 58 between the upper and lower ends 80, 82 greater than the slot height of the opening 56 between the upper end 60 and the lower end 62. As a result, the retention tabs 100*a*, 100*b*, engage the exterior surface 48 of the screen 30 when the attachment hook 58 is inserted through the opening 56 to prevent the attachment hook 58 from being removed through the interior surface 46 of the screen 30.

As stated, the screen system 10 also includes the rail 70, which is configured to attach the screen system to an article of furniture. The rail 70 may be a thin, elongated member that defines an interior face 72, an exterior face 74, an upper rail edge 73 and a lower rail edge 75. The rail 70 defines a rail height between the upper rail edge 73 and the lower rail edge 75. The interior face 72 is adjacent the work surface 14 and the exterior face 74 is opposite the interior face 72. In the embodiment shown in FIGS. 1-9, the rail 70 additionally includes an inner rail 71, also known as an accessory rail. The inner rail 71 may be attached to the rail 70 by any conventional method, and may be spaced inwardly from the rail 70. The inner rail 71 includes an upper rail edge 77 that may be used to support one or more accessories, such as the cup 110, large tray 112, and small tray 114 shown in FIGS. 1-3.

Figure 5:
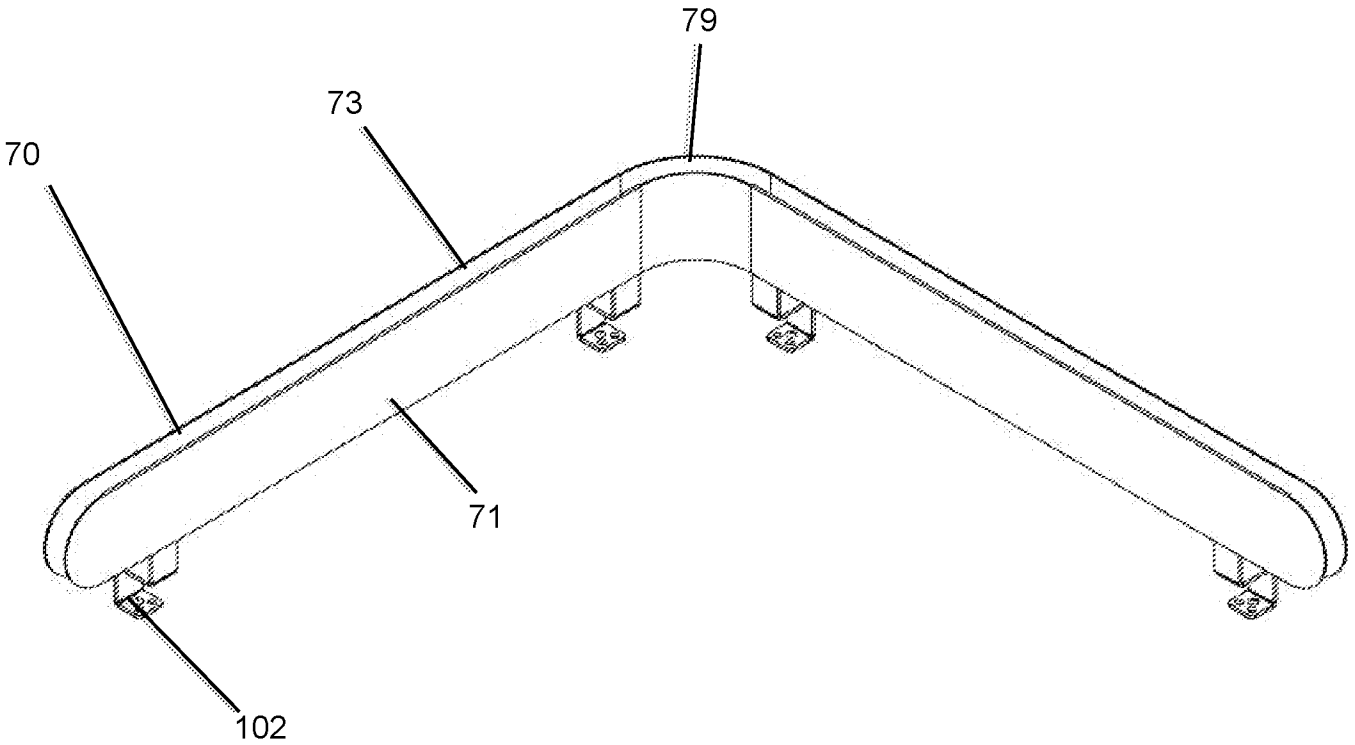
FIG. 5 is a perspective view of a rail according to one embodiment.
Figure 6:
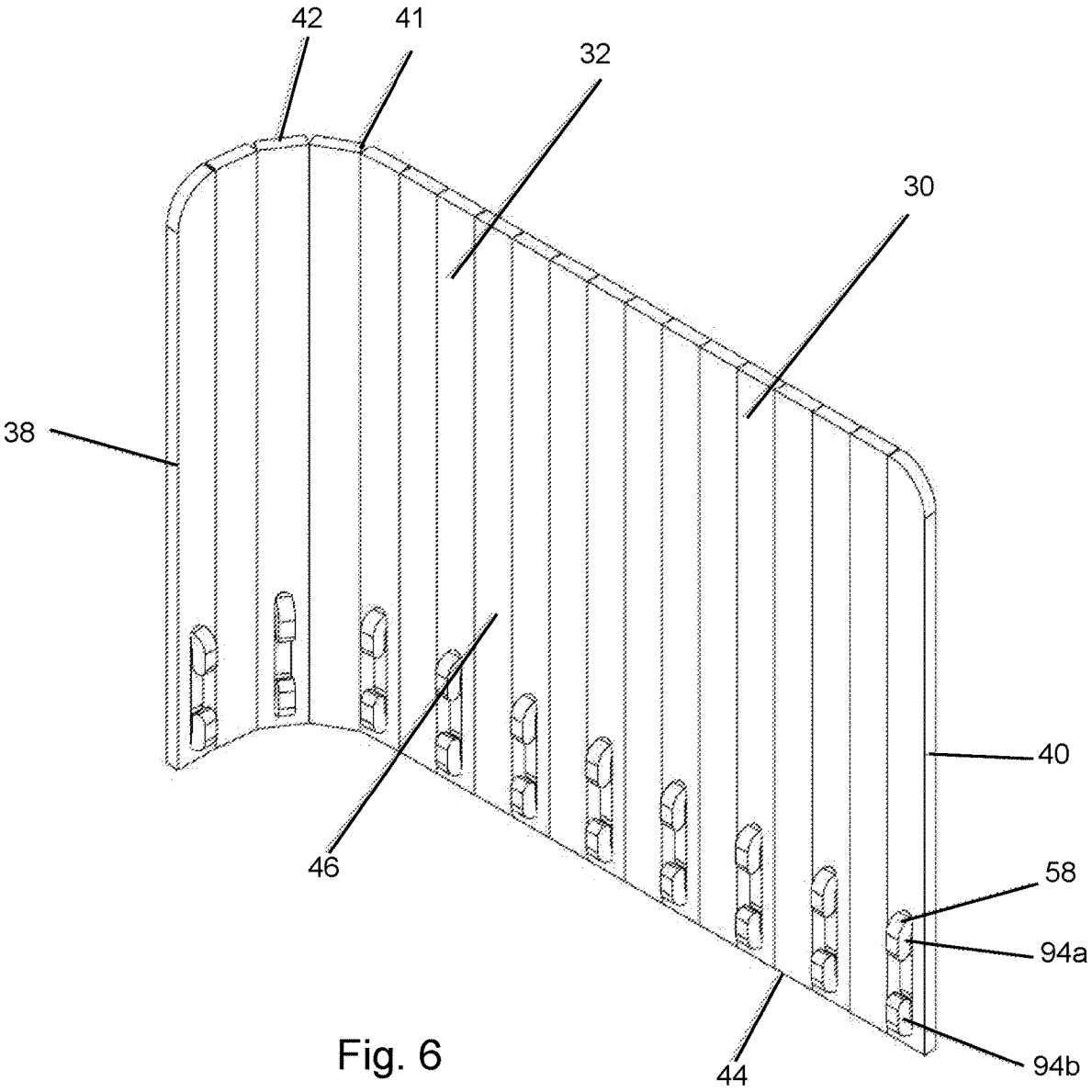
FIG. 6 is a perspective view of a screen according to one embodiment.
Figure 9:
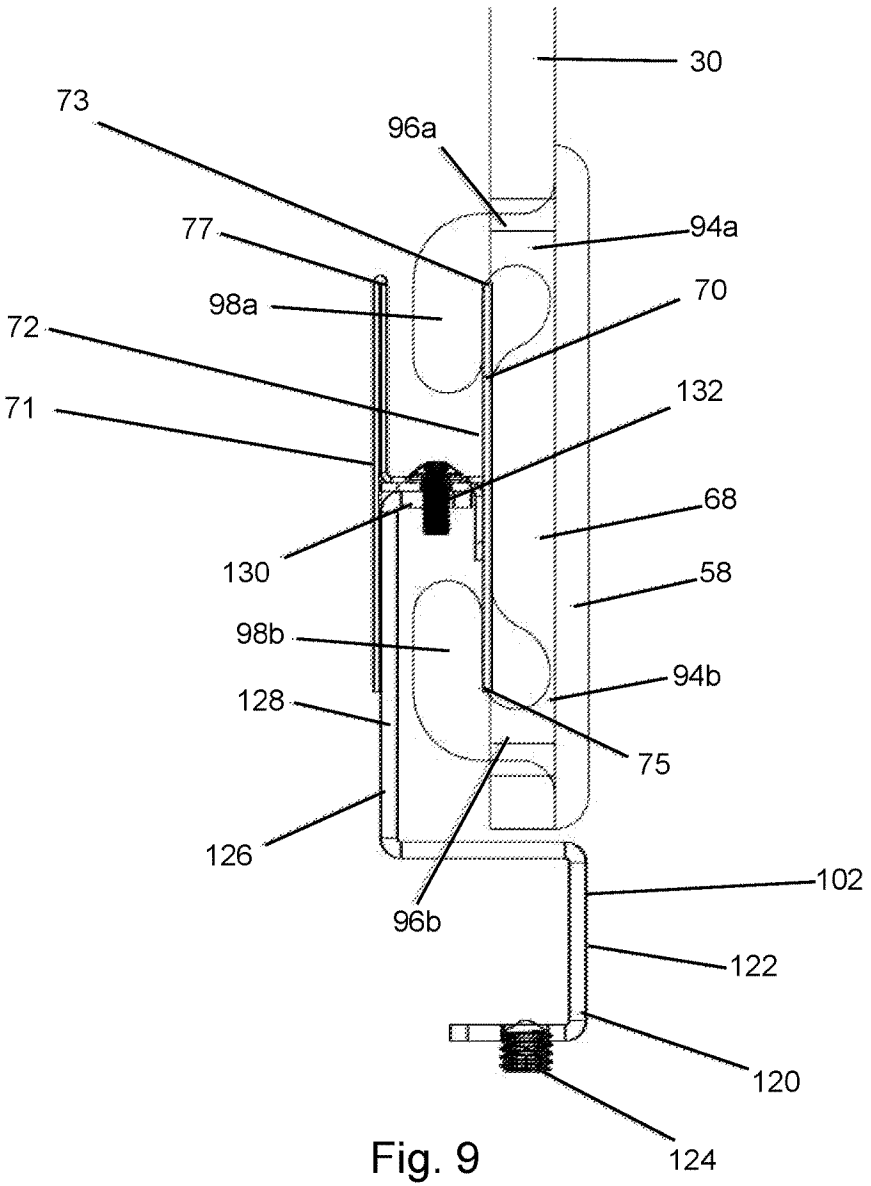
FIG. 9 is a side cross sectional view of a screen attached to a rail according to one embodiment.
Figure 10:
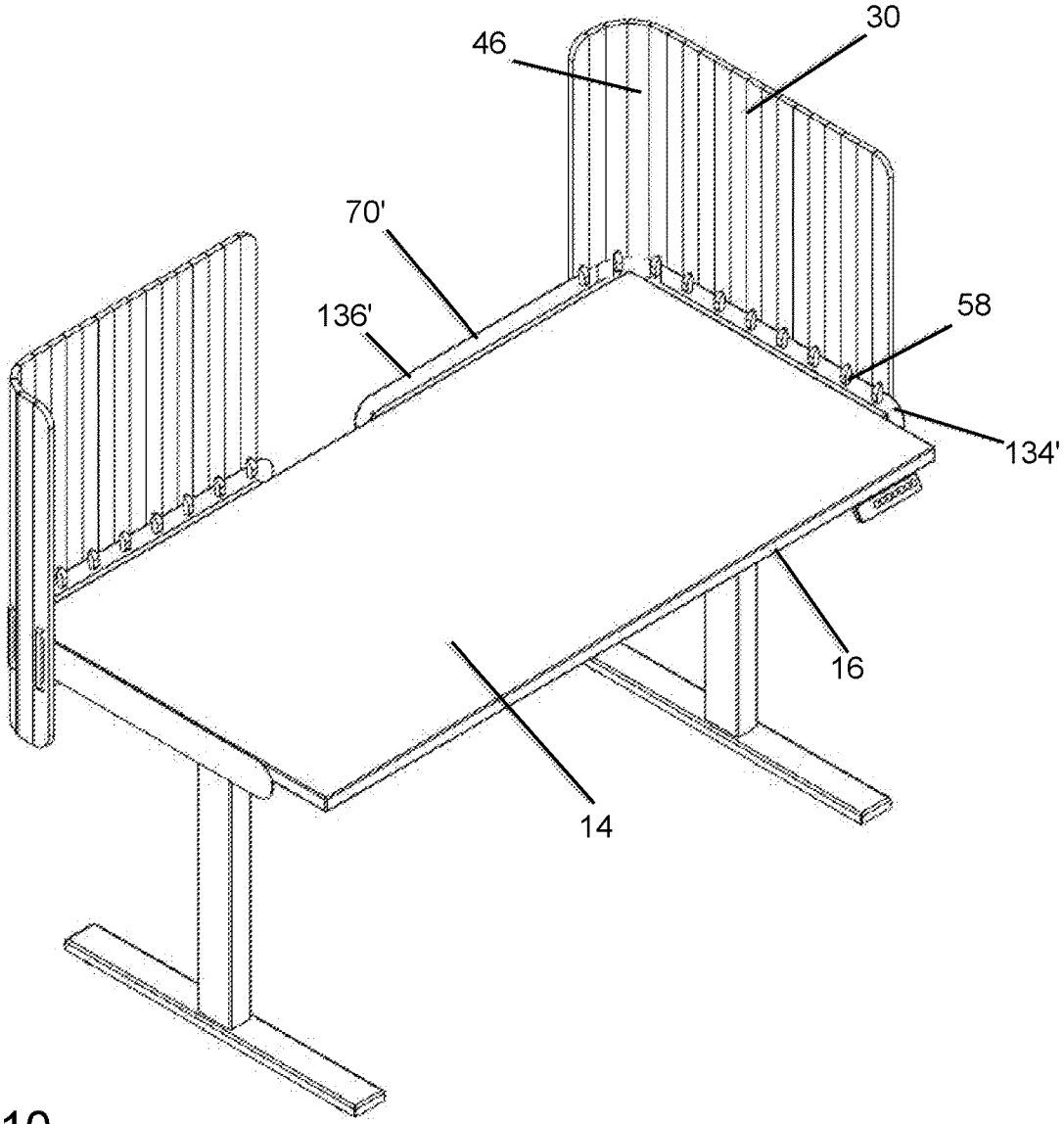
FIG. 10 is a perspective view of a workstation with square corners including a screen system according to a second embodiment of the rail.
Figure 11:
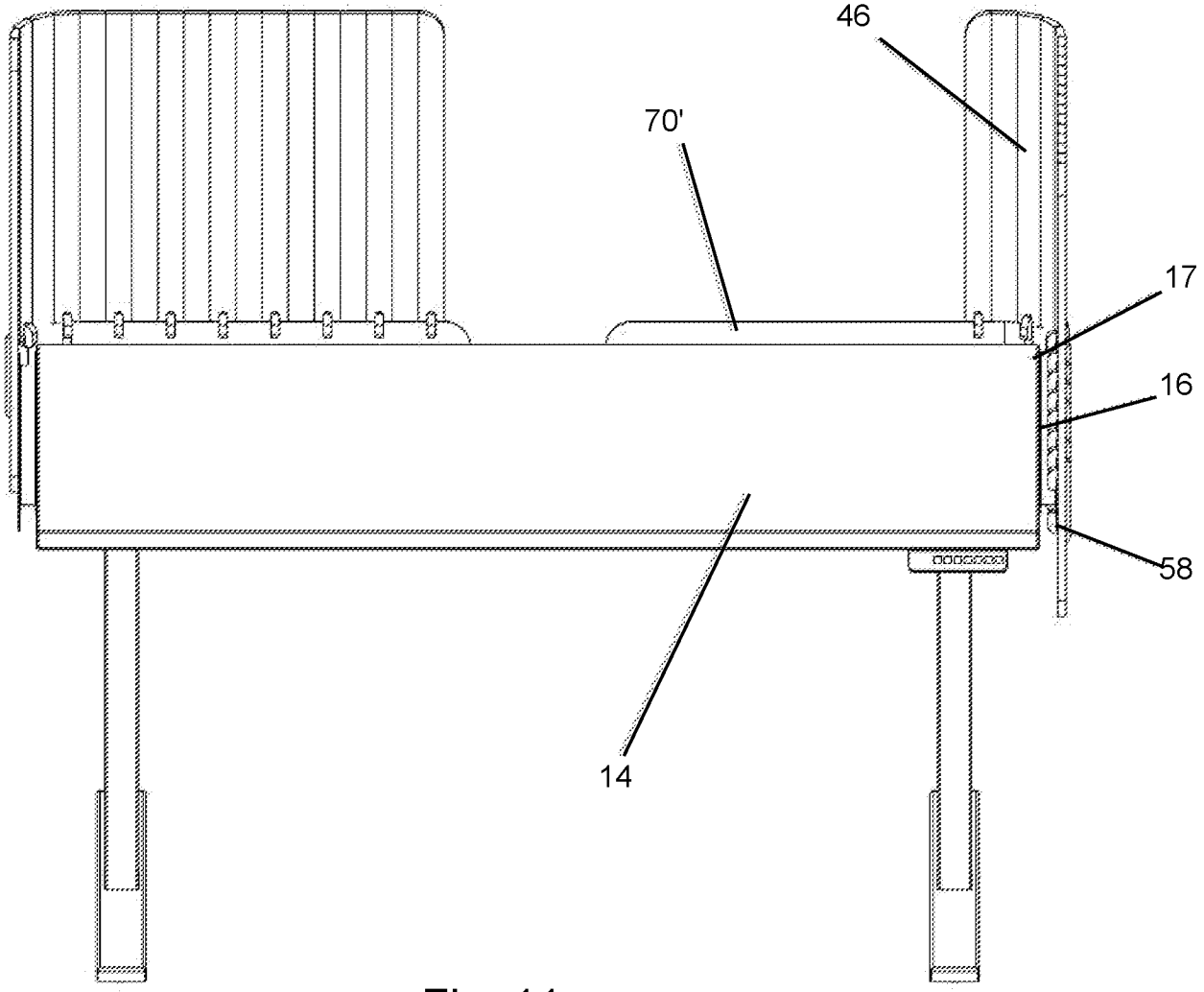
FIG. 11 is a front perspective view thereof.
Figure 12:
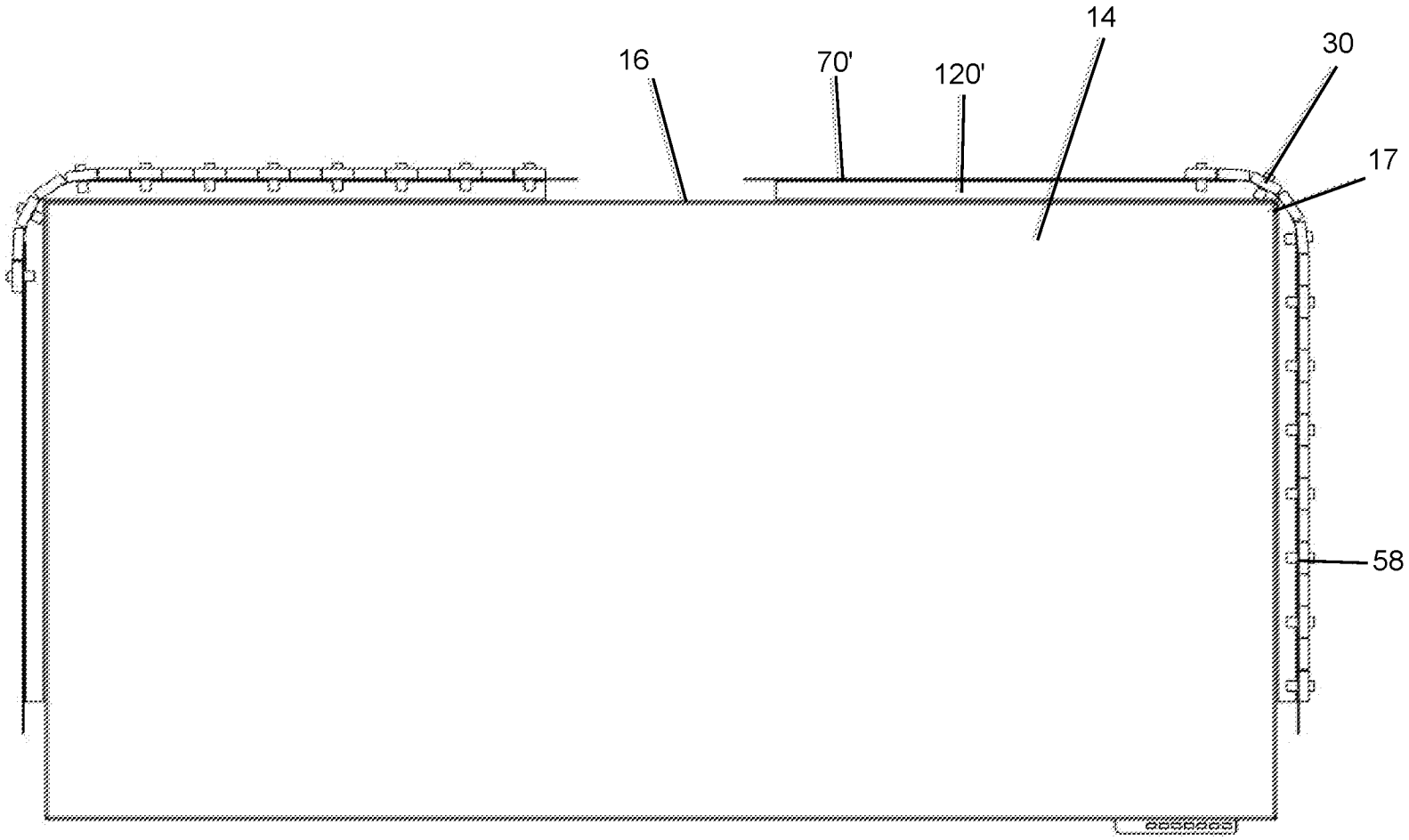
FIG. 12 is a top view thereof.

In the embodiments shown in FIGS. 1-22, the rail 70 is shown affixed to a work surface 14. The rail 70 can be attached to the work surface 14 by suitable fasteners, for example multiple screws, or may be adhered to the work surface 14. In the embodiment shown in FIGS. 1-9, the rail is attached above the work surface 14, such that it generally follows a path above the perimeter edge 16 of the work surface 14. Referring to FIGS. 4, 5 and 9, in one embodiment, the rail 70 includes an attachment portion 102 for attaching the rail to a perimeter edge 16 of the work surface 14. The attachment portion 102 includes an attachment base 120 for connecting to the perimeter edge 16 of the work surface 14. The attachment base 120 includes a U-shaped section 122 that is sized to fit onto the perimeter edge 16 and clamp ono the perimeter edge 16 with a set screw 124. The attachment portion 102 additionally includes a rail support 126 extending upwardly from the attachment base 120. The rail support 126 may include an upward leg 128, and a horizontal leg 130 extending from the upward leg 128. The horizontal leg 130 may be attached to the rail 70 by a conventional method, such as welding. Alternatively, the upward leg 128, or another portion of the attachment portion 120 may attach to the rail 70 by a conventional method. In yet another embodiment, the rail 70 may be formed from one piece, for example, by extrusion or by bending the various portions of the rail 70 into the desired shape. In the embodiment of FIGS. 1-9, which includes the inner rail 71, the inner rail 71 may be attached to the horizontal leg 130 with a fastener 132.

In one embodiment, the rail 70 is designed to extend around a corner 17 of the work surface 14. In the embodiment of FIGS. 1-9, the rail 70 is mounted above the work surface 14, such that the rail 70 may be used in connection work surfaces 14 having curved or square corners. As shown in FIGS. 1-9, the rail 70 extends above the square corner 17 of the work surface 14, and the rail 70 includes a curved section 79 that generally follows the path of the corner 17 as it extends around the corner 17. In this embodiment, however, with the attachment portion 102 positioning the rail 70 above the work surface 14, the curved section 79 does not need to exactly match the shape of the corner 17.

Figure 13:
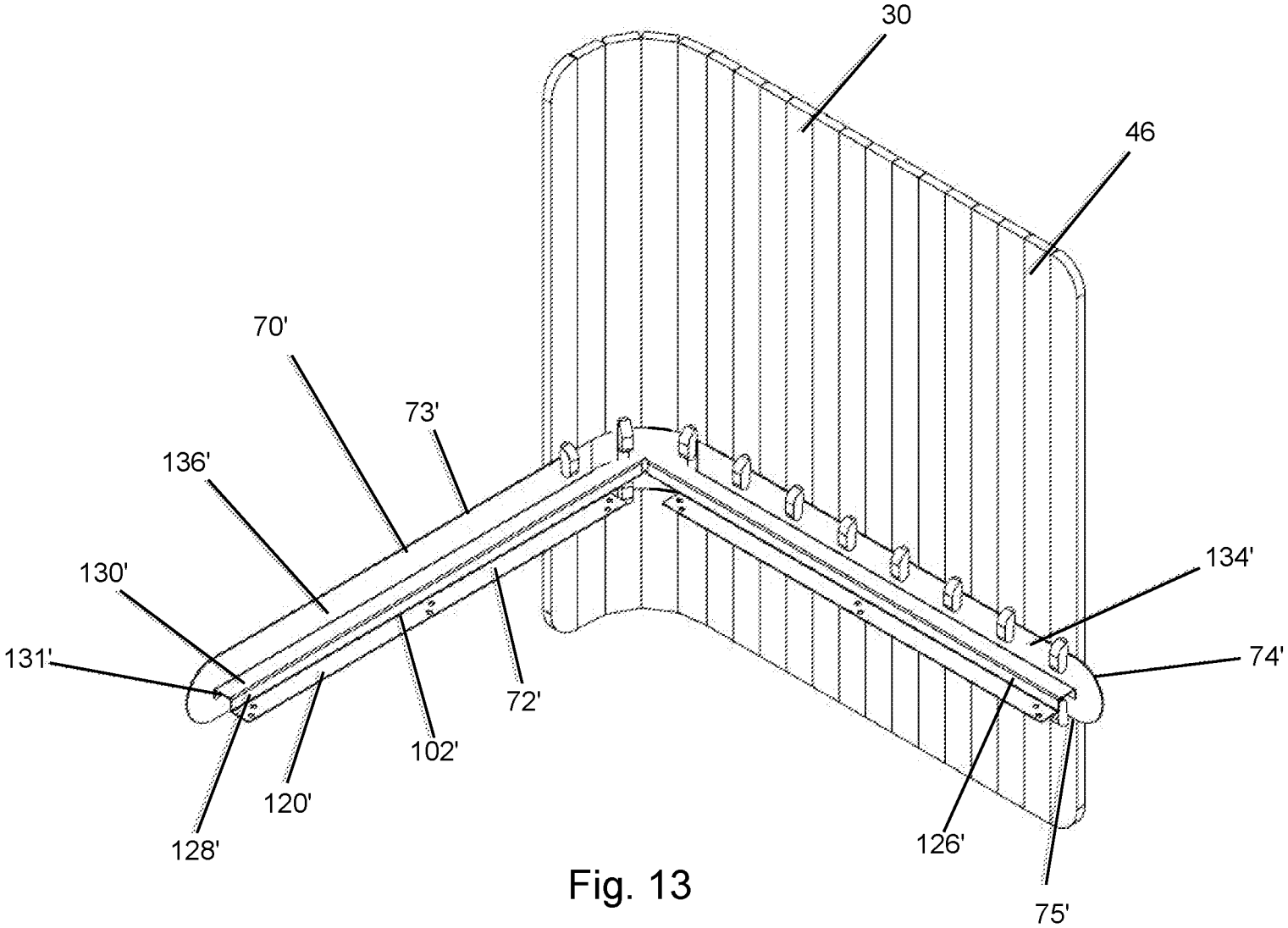
FIG. 13 is a perspective view of the screen and the rail according to the second embodiment.
Figure 14:
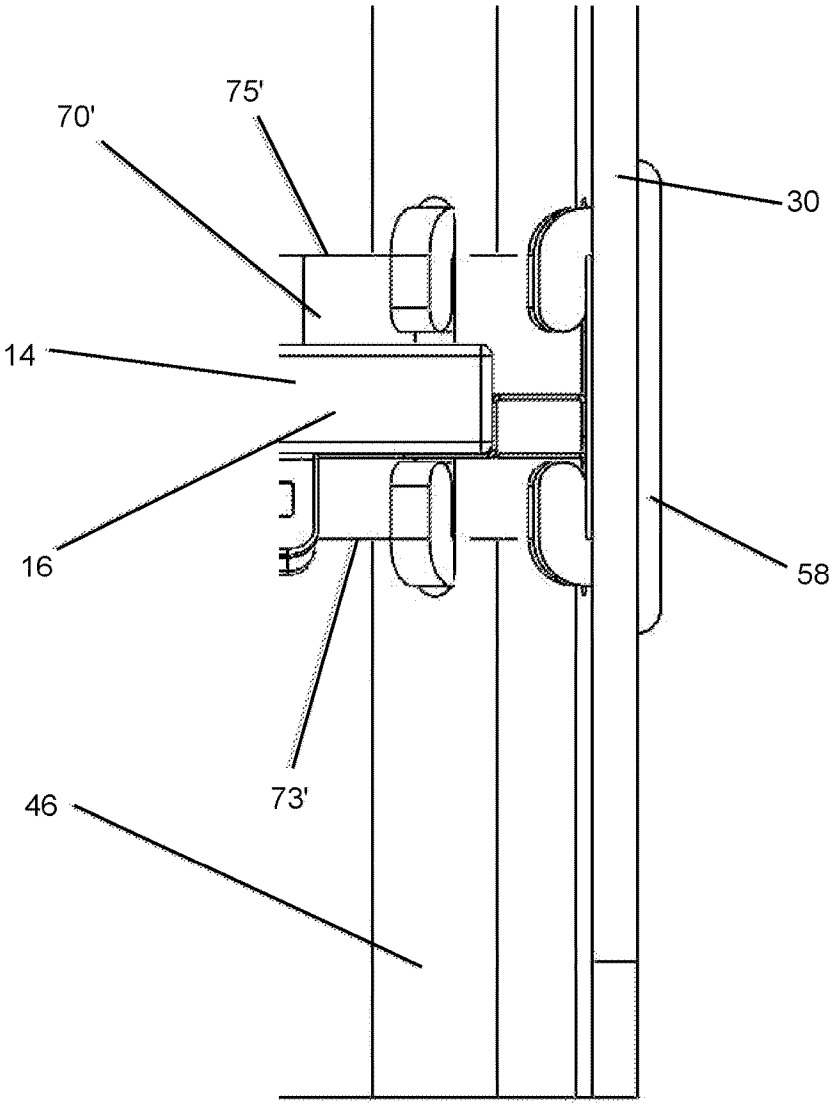
FIG. 14 is a side view of the screen attached to the second embodiment of the rail.
Figure 15:
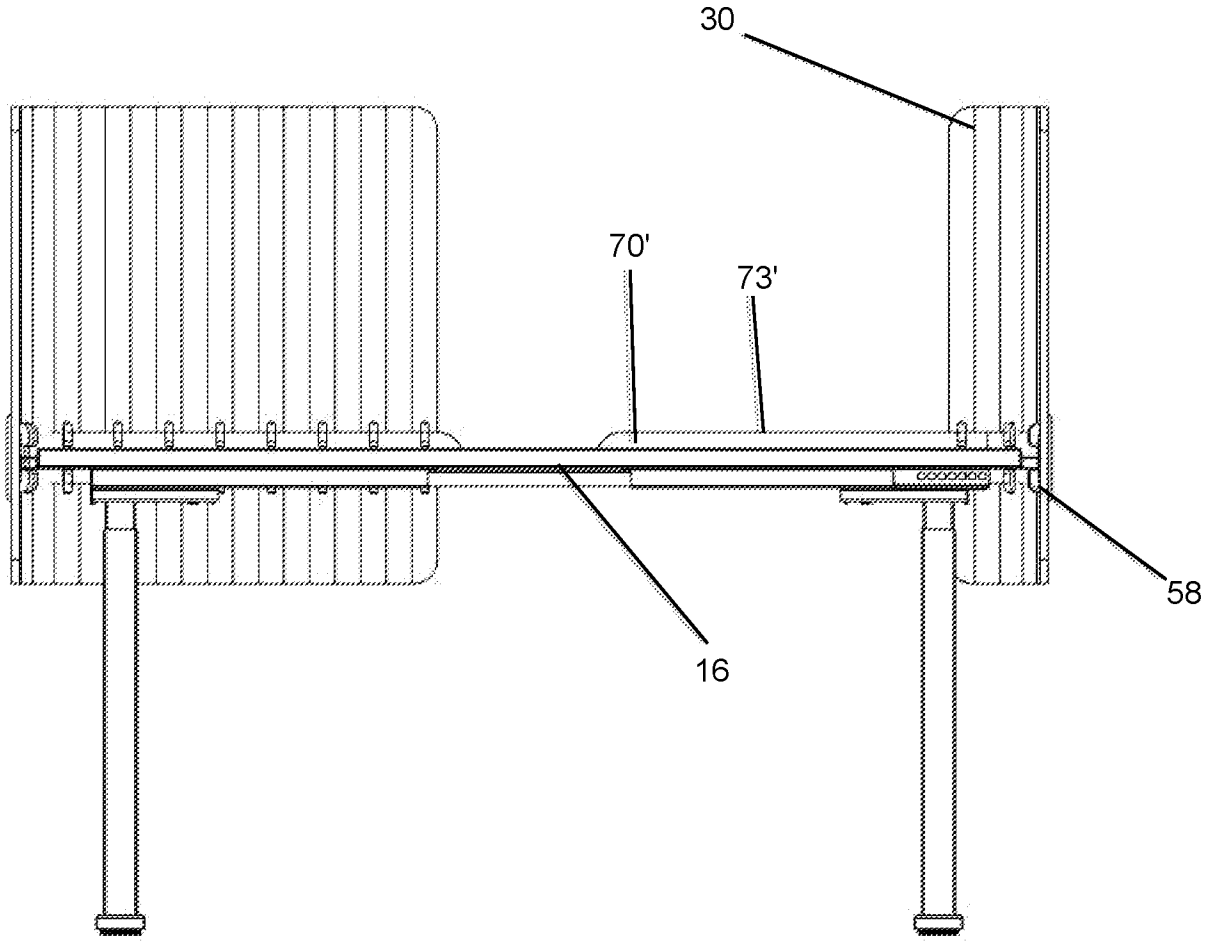
FIG. 15 is a front view thereof.
Figure 16:
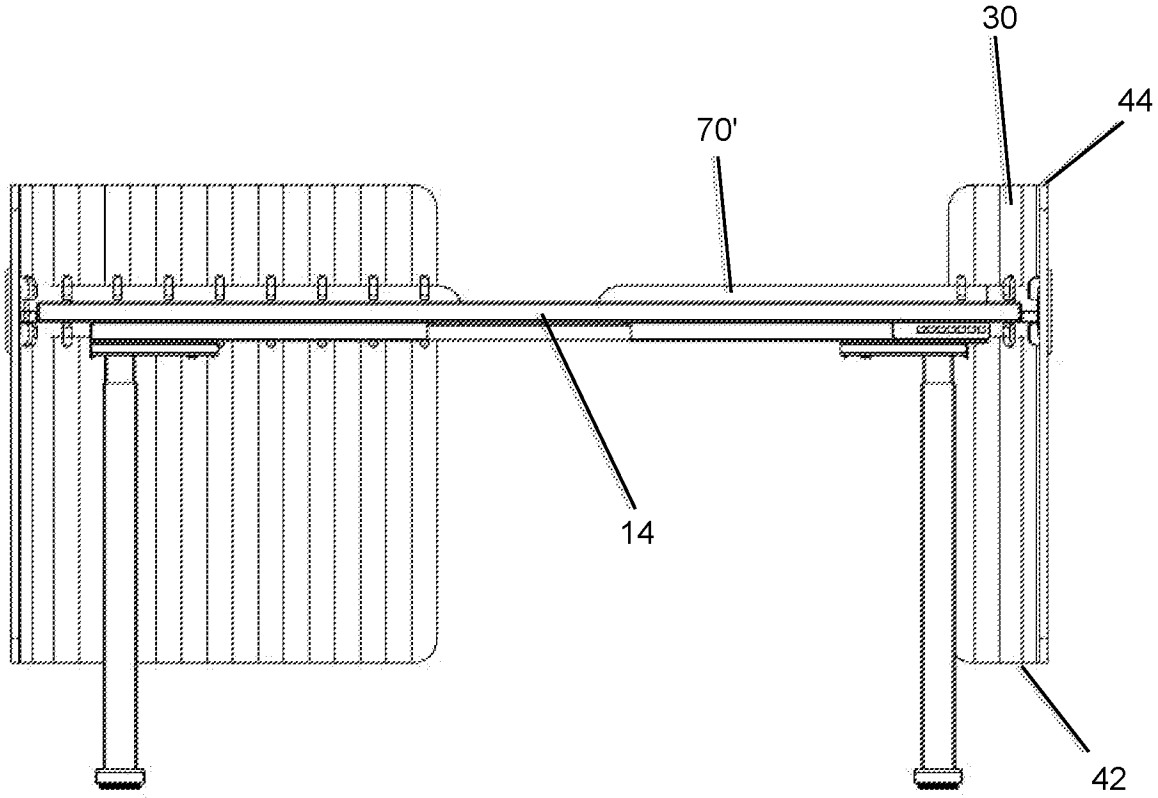
FIG. 16 is a front view of the screen attached to the second embodiment of the rail in a second screen orientation.
Figure 17:
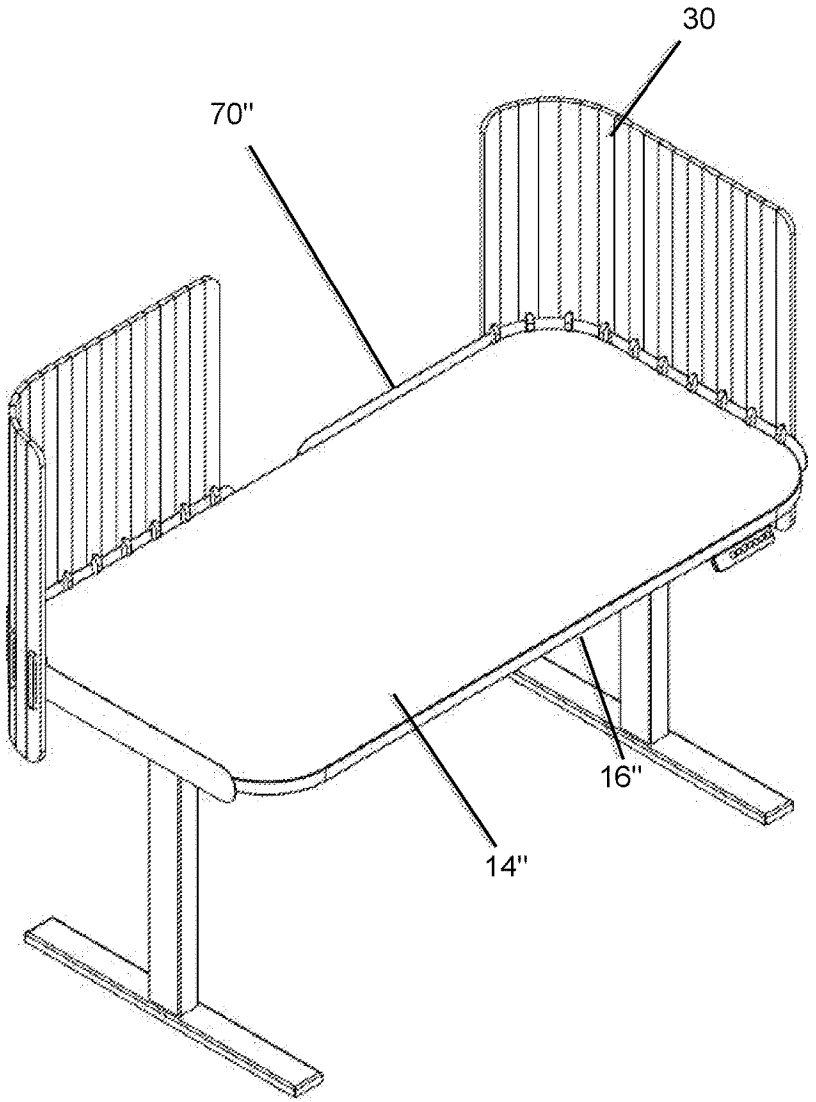
FIG. 17 is a perspective view of a workstation with rounded corners and a screen system with a rail according to a third embodiment of the rail.
Figure 18:
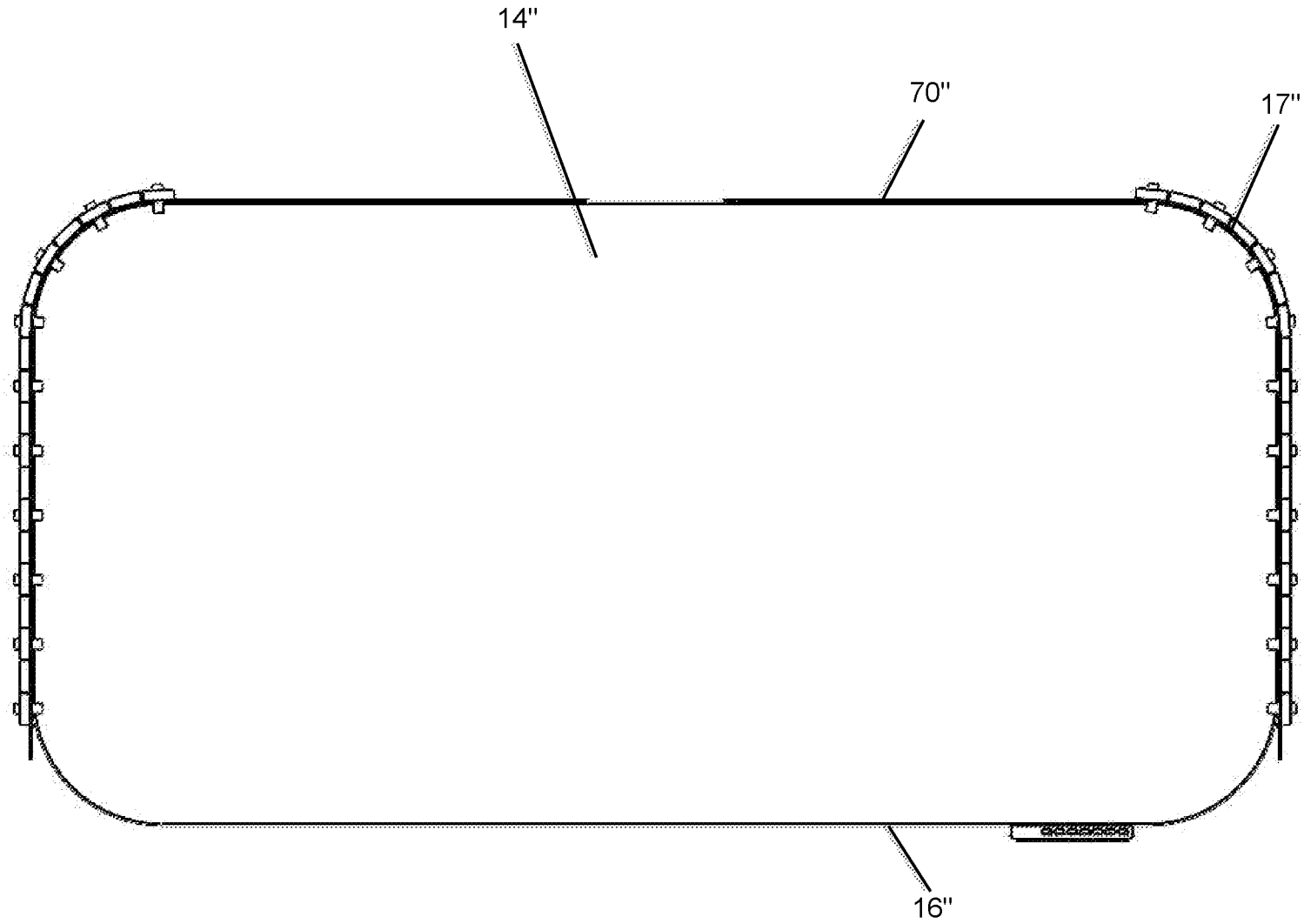
FIG. 18 is a top view thereof.
Figure 19:
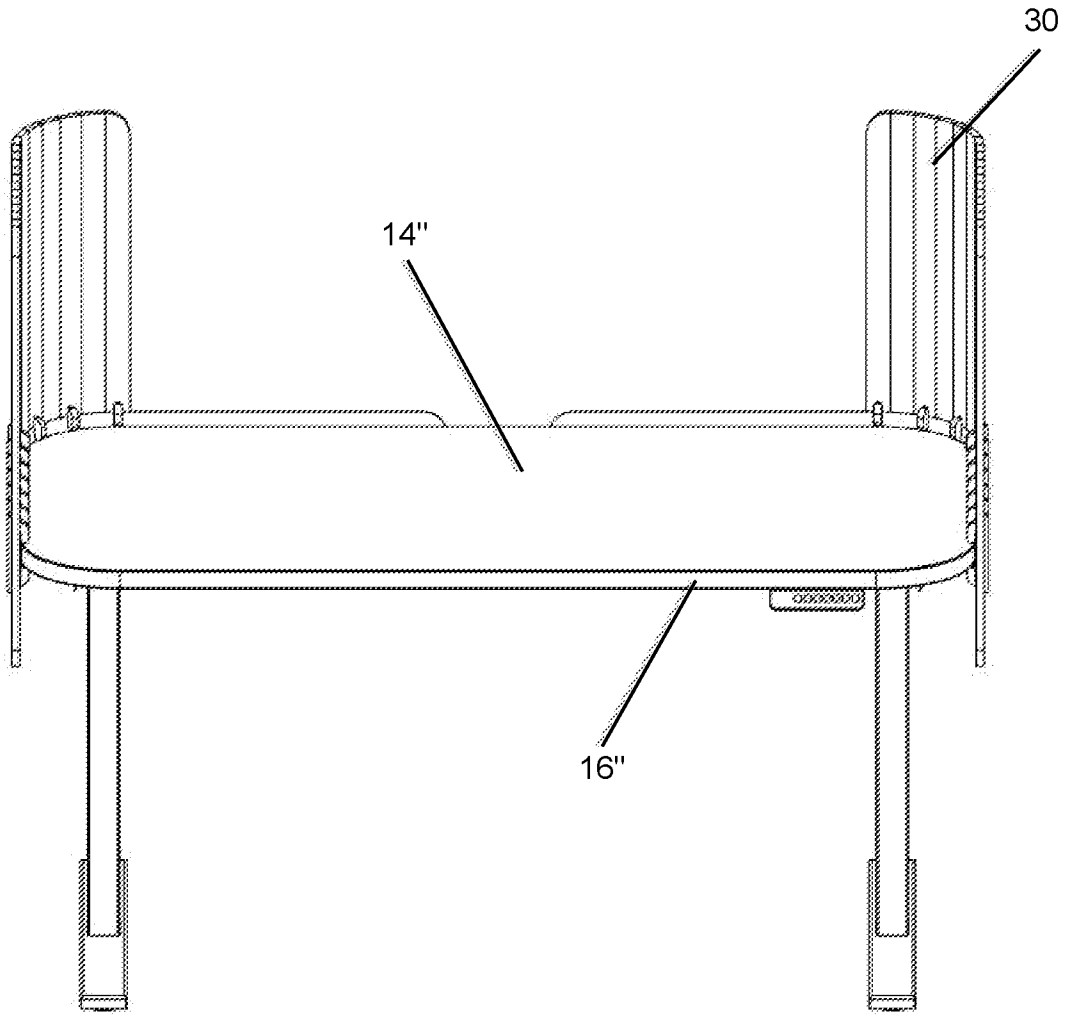
FIG. 19 is a front perspective view thereof.

FIGS. 10-16 show a second embodiment of the rail 70'. This embodiment is similar to the rail 70 of FIGS. 1-9, except that the rail 70' is an "outboard" rail 70', wherein the rail 70' is designed to attach around the outside of the perimeter edge 16 of the work surface 14 instead of above the work surface 14. More particularly the embodiment of FIGS. 10-16 shows an outboard rail 70' for use with a work surface 14 having a perimeter edge 16 with a square corner 17. Referring to FIG. 13, in this embodiment, the rail 70' includes an attachment portion 102' that attaches directly to the interior face 72' of the rail 70'. As illustrated, the attachment portion 102' of this embodiment includes an attachment base 120' formed by a flange that can attach to the work surface 14 with one or more fasteners. The attachment portion 102' additionally includes a rail support 126' extending from the attachment base 120'. In this embodiment, the rail support 126' is a generally U-shaped channel having an upward leg 128', a horizontal leg 130' and a rail leg 131', with the rail leg 131' attached to the interior face 72'. The attachment portion 102' includes first 134' and second 136' sections that extend at an angle with respect to each other, and in the illustrated embodiment extend at a right angle to one another to attach about the square corner 17' of the work surface 14. The interior 72' and exterior 74' faces of the rail 70' may be curved to provide curved upper and lower rail edges 73', 75' for enabling the sliding of the screen 30 with respect to the rail 70'. In this embodiment, the screen 30 may attach to and slide with respect to the rail 70' in the same manner as the first embodiment described above. FIG. 14 shows a closeup of the screen 70' according to the outboard attachment design, with the interior face 72' of the rail 70' and the interior surface 46 of the screen 30 facing the perimeter edge 16' of the work surface 14'. FIG. 16 shows the screen 30 attached to the work surface 14 with the outboard rail 70' in the same manner as in FIGS. 10-15, except that the screen 30 is flipped 180 degrees such that a greater portion of the screen 30 extends below the work surface 14 than above the work surface 14 to enable the screen 30 to function as an adjustable modesty panel.

Figure 20:
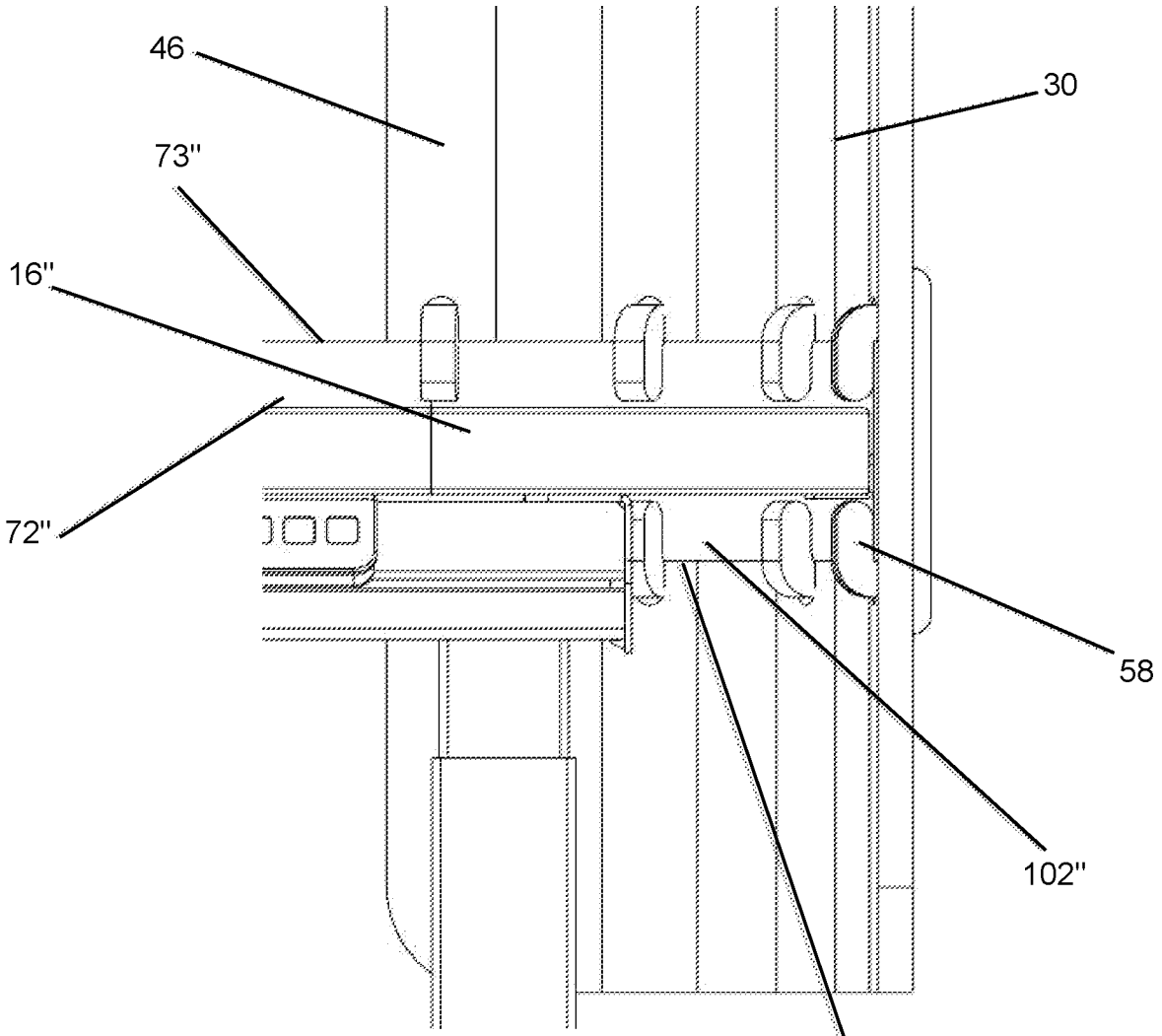
FIG. 20 is a side view of the screen attached to the third rail embodiment.
Figure 21:
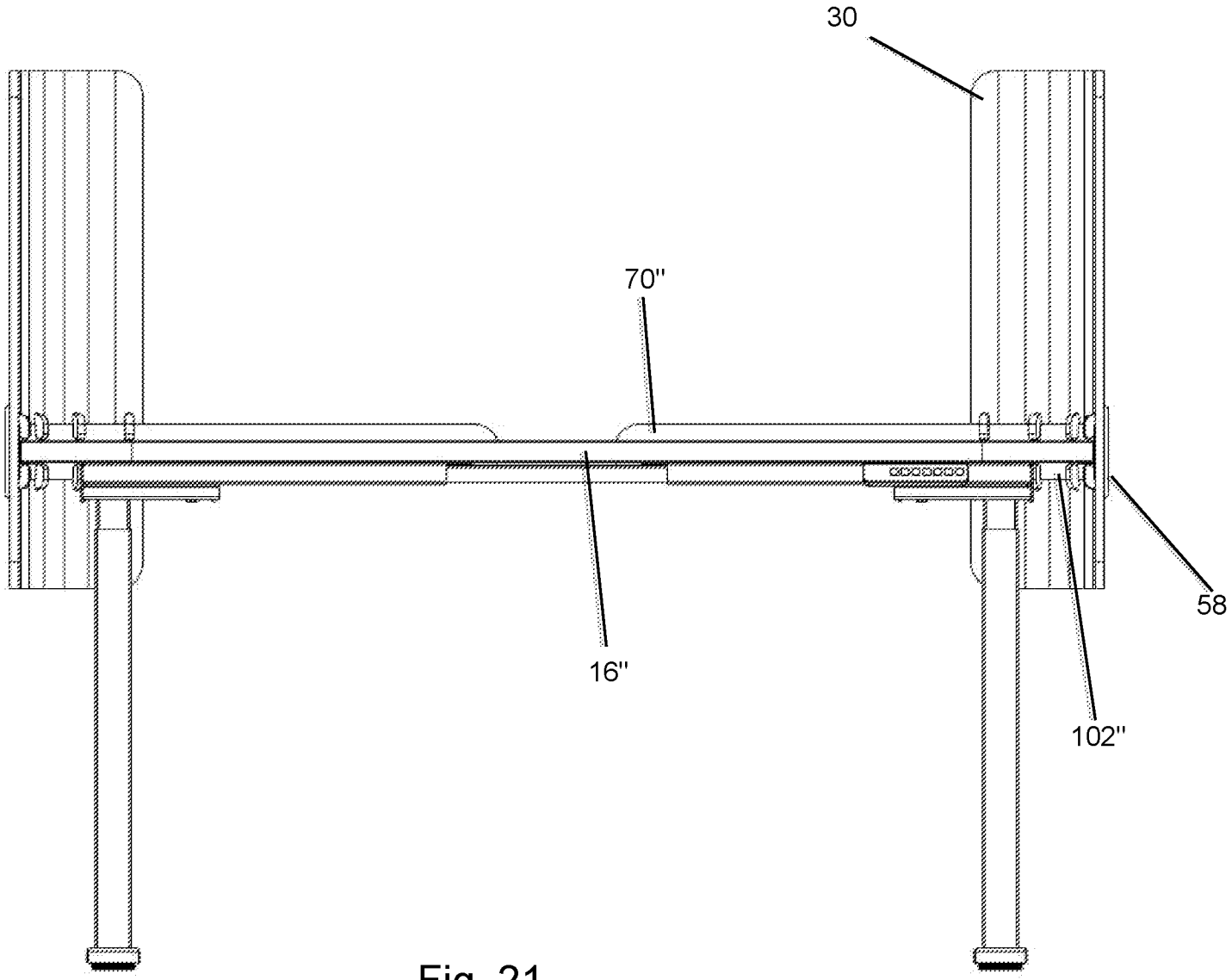
FIG. 21 is a front view thereof.
Figure 22:
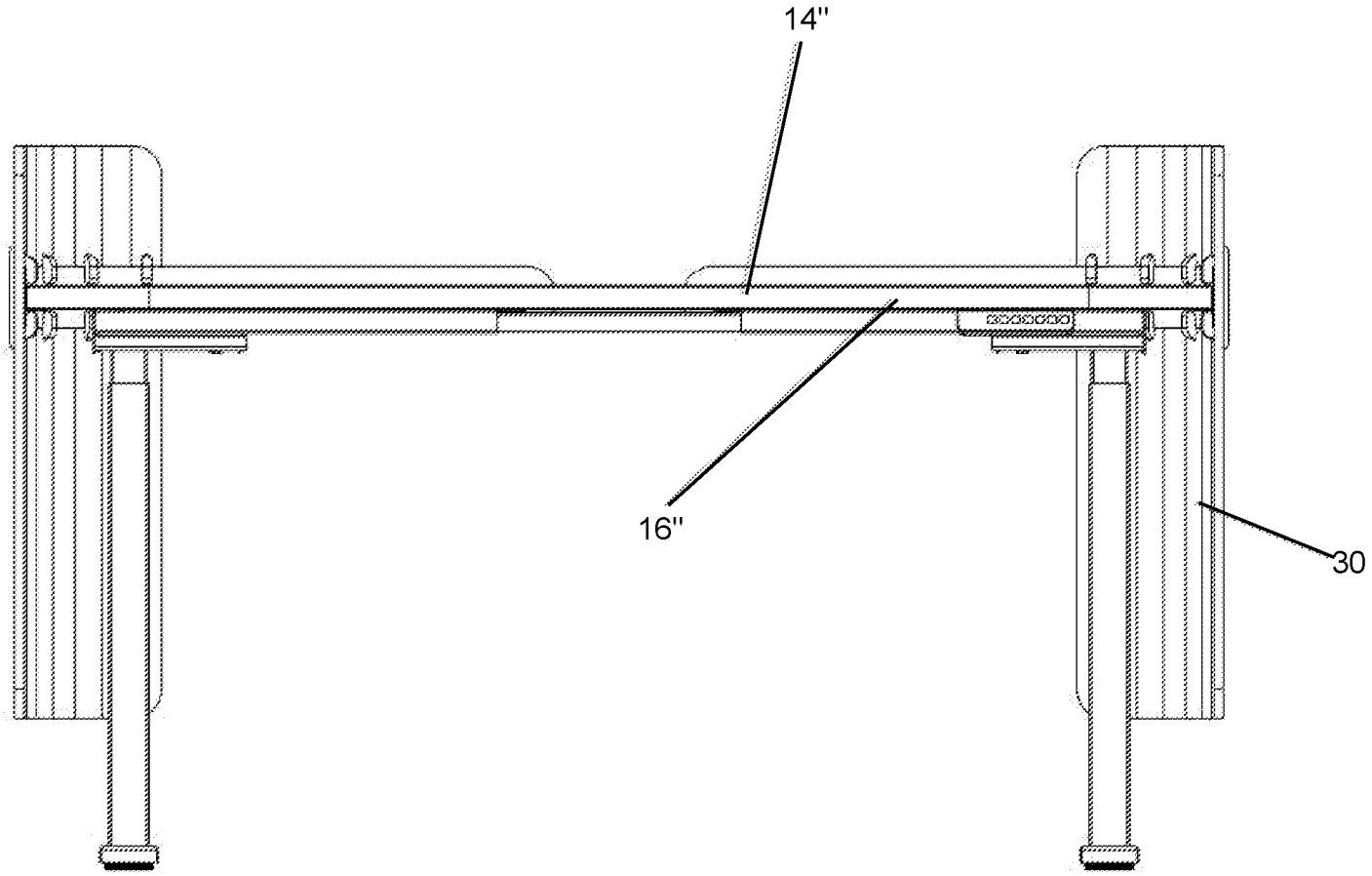
FIG. 22 is a front view of the screen attached to the third embodiment of the rail in the second screen orientation.

FIGS. 17-22 show another embodiment of the rail 70" for use with the screen 30. This embodiment shows an outboard rail similar to the rail 70' of FIGS. 10-16, except that the rail 70" is designed for use with a work surface 14" having a perimeter edge 16" with a rounded corner 17". In this embodiment, the rail 70" includes an attachment portion 102" that attaches directly to the interior face 72" of the rail 70" in the manner of the rail 70' described above. The attachment portion 102' extends in a continuous curve that generally matches the curve of the rounded corner 17" of the work surface 14". The interior 72" and exterior 74" faces of the rail 70" may be similarly curved to provide curved upper and lower rail edges 73", 75" for enabling the sliding of the screen 30 with respect to the rail 70". In this embodiment, the screen 30 may attach to and slide with respect to the rail 70' in the same manner as the first and second embodiments described above. FIG. 20 shows a closeup of the screen 70" according to this outboard attachment design, with the interior face 72" of the rail 70" and the interior surface 46 of the screen 30 facing the perimeter edge 16" of the work surface 14". FIG. 22 shows the screen 30 attached to the work surface 14" with the outboard rail 70" in the same manner as in FIGS. 17-21, except that the screen 30 is flipped 180 degrees such that a greater portion of the screen 30 extends below the work surface 14" than above the work surface 14" to enable the screen 30 to function as an adjustable modesty panel. Additional embodiments for attaching a rail 70 to a work surface 14, or to another surface of an article of furniture, may also be used, depending on the desired application. For example, in one embodiment, a rail may be attached to the underside of a work surface, or directly to the perimeter edge of a work surface, or, as discussed in more detail below, to an article of furniture for use as a slidable covering or door. In each embodiment, at least an upper or lower edge of the rail is accessible for sliding attachment by the screen 30.

Figure 2:
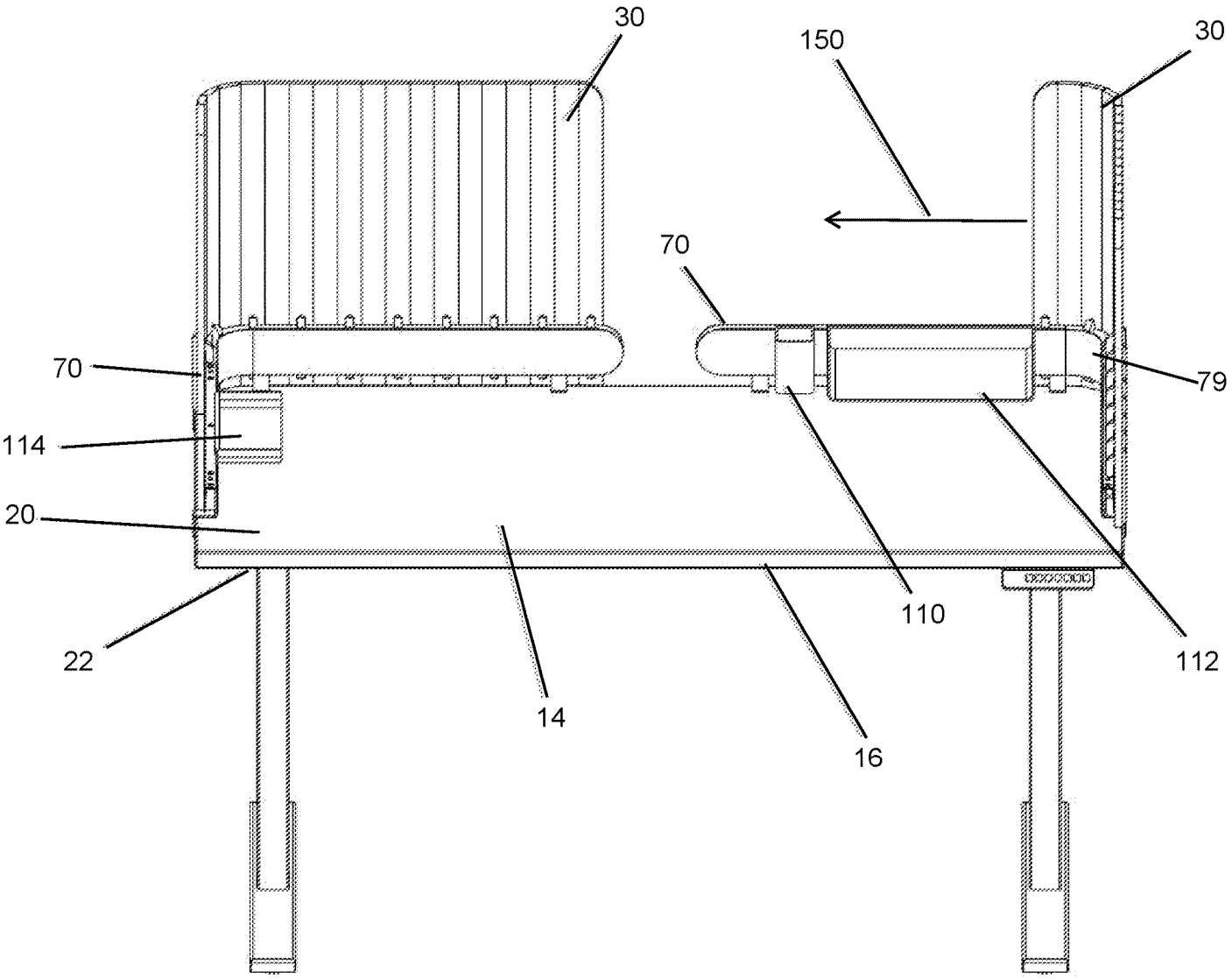
FIG. 2 is a front view thereof.
Figure 3:
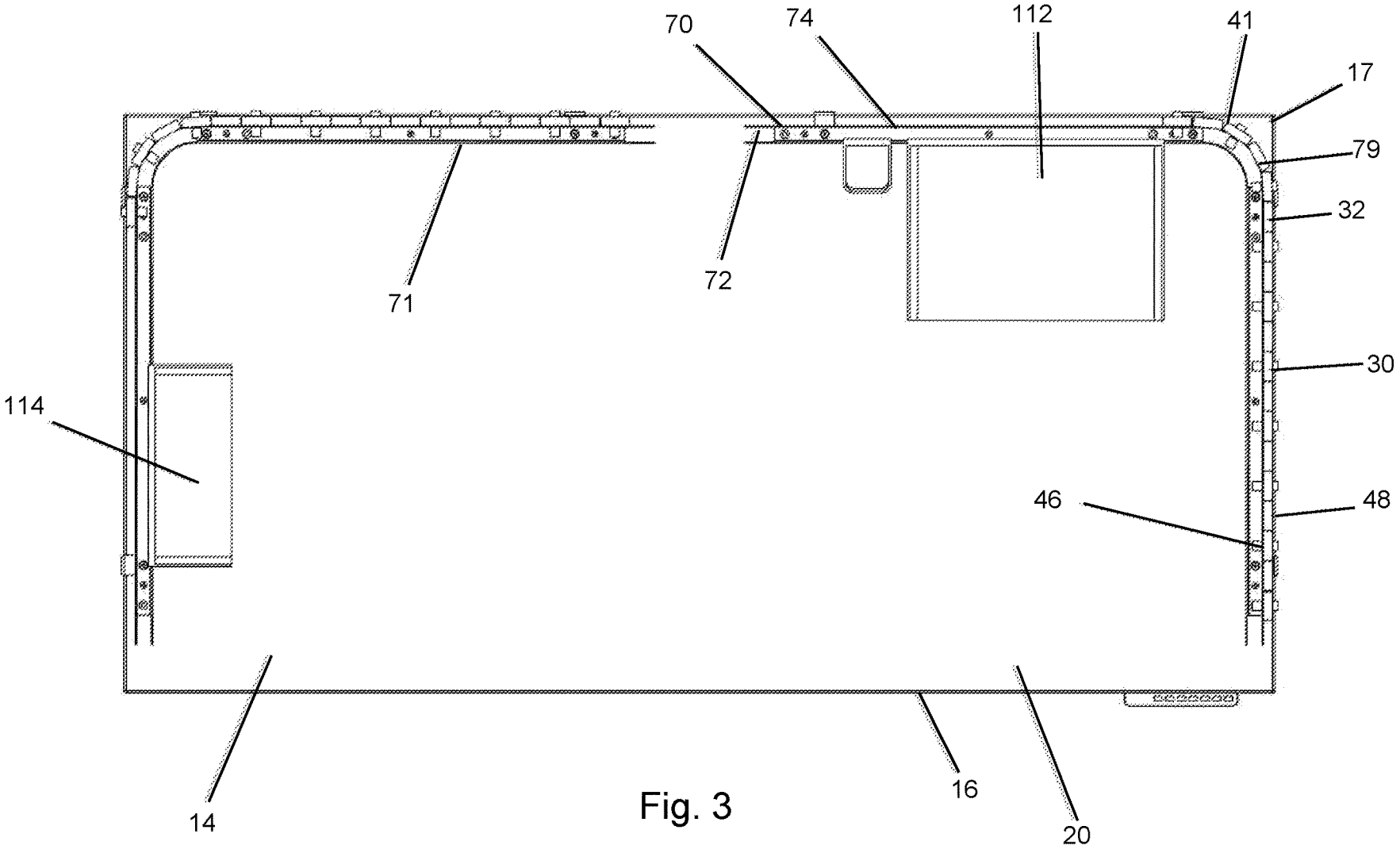
FIG. 3 is a top view thereof.

The screen 30 slidably attaches to the rail 70, 70', 70" by the engagement of one or more of the attachment hooks 58 with the rail 70. More particularly, the hooks 94 of the attachment hooks 58 engage one of the upper 73 or lower 75 rail edges to attach the screen 30 to the rail 70. In the embodiment shown in FIG. 9, the first hook **94*a* extends over and abuts the upper rail edge 73 and the second hook 94*b* extends underneath and abuts the lower rail edge 75. The second legs 98*a*, 98*b* of the hooks 94*a*, 94*b* extend over and engage the interior face 72 of the rail 70. In the illustrated embodiment, the front surface 86 of the base 68 abuts the exterior face 74 of the rail 70 in the area of the hill 90, such that the rail 70 is captured by the attachment hooks 58 but the attachment hooks 58 are slidable along the rail 70. Referring to FIG. 2, a plurality of the attachment hooks 58 are similarly slidably attached to the rail 70, and the screen length is less than the rail length such that the screen 30 can be adjusted along the length of the rail 70 by sliding the screen 30 in the direction of the arrow 150 from a first screen position in which the screen 30 provides privacy along a side edge 152 of the work surface 14 to a second position in which the screen 30 is pulled around the corner 17 and positioned along a rear edge 154 of the work surface 154**.

The position of the privacy screen 30 can be adjusted to provide a visibility barrier for a desired area of the work surface 14. Moreover, the privacy screen 30 may be designed to follow the perimeter 16 of the work surface 14, including around corners and curves. As stated above, the main body 32 is flexible in the horizontal direction (i.e., the direction generally parallel to the upper surface of the worksurface), where shape of the main body 32 enables the flex lines 41 to move and flex relative to one another, thus conforming to a curved perimeter 16, as well as any planar or straight perimeter. In the illustrated examples, the work surface 14 and perimeter 16 have a rectangular shape with square or rounded corners 17, 17'. As the privacy screen 30 follows the rail 70, 70', 70" above or around the corner or rounded portion of the perimeter 16, flex lines 41 flex. While the exemplary work surface 14 includes convex portions of the perimeter 16, the privacy screen 30 could also conform to concave portions and other planar and non-planar work surface 14 perimeters 16.

The privacy screen 30 can provide privacy and/or modesty for the user by acting as a visibility barrier. "Privacy," as used herein, refers to a visibility barrier above the work surface 14, while "modesty" refers to a visibility barrier below the work surface 14. According to an embodiment, the privacy screen 30 may be mounted to the rail 70 in an upright orientation or an inverted orientation (see FIGS. 16, and 22). In other words, the privacy screen 30 may be mounted to the rail 70 right side up or upside down. Referring to the illustrated embodiments, when the openings 56 are positioned above or below a midpoint of the screen height, the screen 30 presents a major portion of the main body 32 above the work surface 14, and, in the inverted orientation, a minor portion of the screen height is disposed above the work surface 14. Accordingly, when the cutouts 56 are offset above or below the midpoint of height H, the privacy screen 30 may selectively be oriented to provide more privacy (FIGS. 1-15 and 17-21) or more modesty (FIGS. 16 and 22).

Also as illustrated, the screen system 10 may include multiple screens 30, which may be arranged in any desired combination and orientation. The screens 30 can be mounted to the rail 70, or to separate rails. The screen system 10 with multiple privacy screens 30 can also be arranged to include a gap between rails 70 and privacy screens 30, forming additional separation between workstations as desired by the user or installer.

To install and position the screen system 10, the rail 70 is affixed to the work surface 14 at the perimeter 16 of the work surface 14 and extends around as much of the perimeter 16 of the work surface 14 is desired. According to the illustrated embodiments, the rail 70 is installed such that it is completely above the work surface 14, whereas the rails 70', 70" are installed in an outboard arrangement. A leading edge of the screen 30 (either the left or right edge 38, 40 of the main body 32) is slid onto the rail 70 by inserting the rail 70 into attachment hooks 58 as noted above. Once the screen(s) 30 is mounted to the rail 70, the screen 30 may be slid into position and orientation as desired to change and adjust the visibility barrier provided by the screen body 32. Adjustment of the position of the screen body 32 between upright and vertical orientations can be made as many times as desired to switch the privacy screen 30 between providing primarily privacy, modesty, or both privacy and modesty. It should be appreciated that such repositioning can occur by removing and reinstalling the main body 32 onto the rail 70, and that the system 10 can be assembled on a newly manufactured work surface 14 or article of furniture, or alternatively retrofitted onto an existing work surface 14 to provide a degree of privacy and physical separation between users of an existing work surface 14 or "benching" style work surface arrangement.

As described herein, the privacy screen system 10 can provide the desired degree of privacy, including the position along a perimeter of the work surface 14 for which the privacy screen 30 provides a physical and visibility barrier, as well as providing a visibility barrier above and/or below the work surface 14. The privacy screen 30 may be positioned to provide a more private, personal work space that may be desirable for individual work and for adding a barrier between users, or may be positioned to provide a more open work space to better facilitate group collaboration and communication as is sometimes desired in an office environment.

Figure 23:
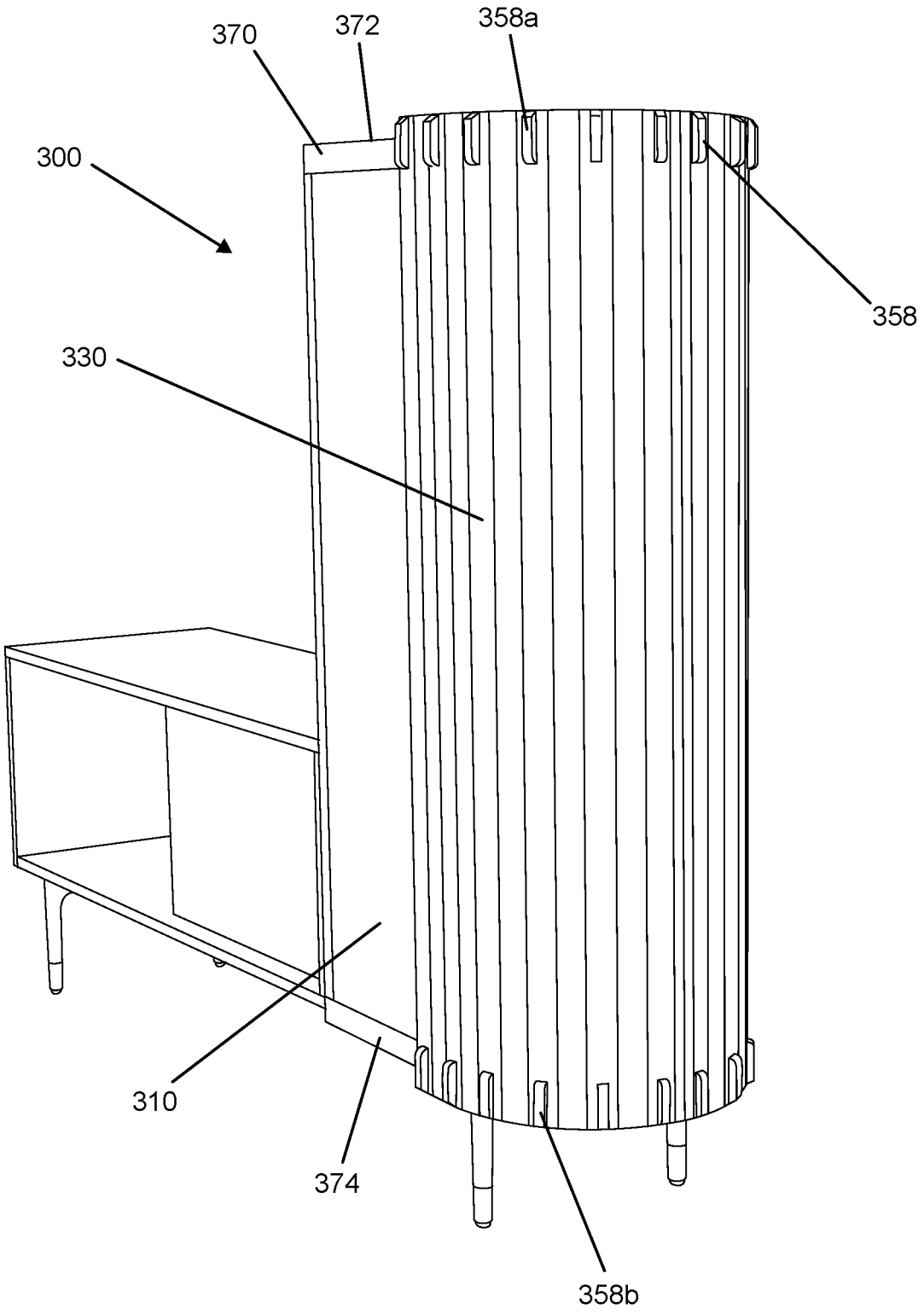
FIG. 23 is a perspective view of another embodiment of the screen system.
Figure 24:
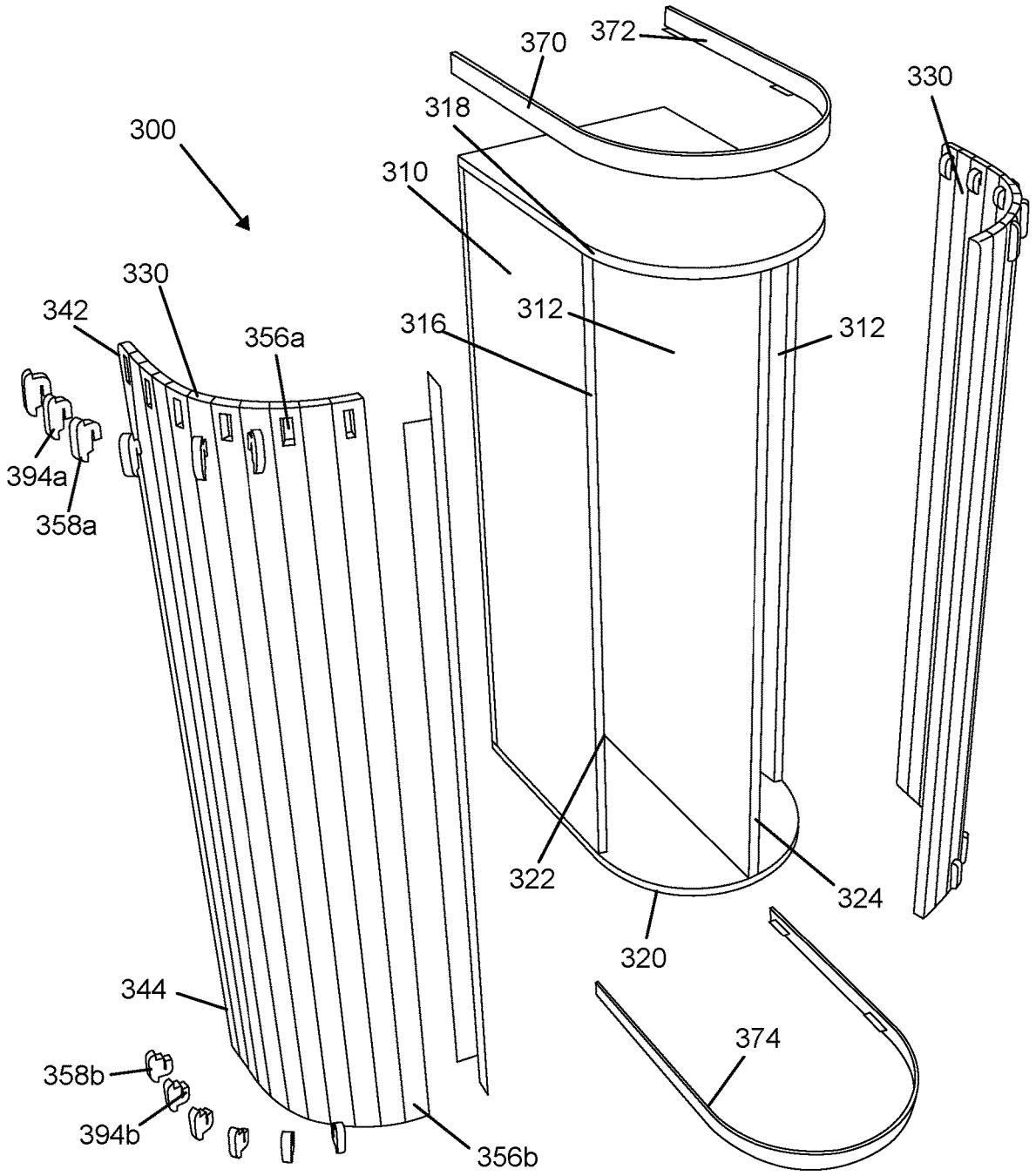
FIG. 24 is an exploded view thereof.

Alternative applications of the screen system 300 are shown in FIGS. 23-24. In these embodiment, the screen system 300 attaches to an article of furniture other than a work surface 14 to slidably adjust with respect to the article of furniture. More particularly, in these embodiments, the screen 330 attaches to a cabinet 310 and forms a sliding door for the cabinet 310. FIGS. 23-24 show two screens 330 that combine to cover (and uncover) an opening 312 of the cabinet 310. As shown in FIG. 24, the cabinet 310 defines a pair of openings 312, and each screen 330 covers one of the openings 312. Each opening 312 includes a mouth defined by a perimeter edge 316. Each perimeter edge includes an upper rim 318, a lower rim 320, a first side rim 322 and a second side rim 324.

The screen system 300 includes a rail 370 attached along at least a portion of the perimeter edge 316. With reference to FIGS. 23 and 24, the rail 370 includes an upper rail 372 and a lower rail 374. The upper rail 372 is positioned adjacent to the upper rim 318 and the lower rail 374 is positioned adjacent to the lower rim 320. In the illustrated embodiment, both of the upper and lower rails 372, 374 are U-shaped rails that extend along the upper rims 318 and lower rims 320 of both of the openings 312 in the cabinet 310. The rails 372, 374 extend rearwardly beyond the side rims 324 to enable the screens 330 to slide to an open position in which the screens 330 do not cover the openings 312 to provide access to the openings 312.

In the embodiment of FIGS. 23 and 24, the screens 330 define openings 356 for receiving attachment hooks 358. With reference to FIG. 24, in this embodiment, the openings 356 each include an upper opening **356*a* positioned near the upper edge 342 of the screen 330 and a lower opening 356*b* positioned near the lower edge 344 of the screen 330. The openings 356*a*, 356*b* may be formed in upper and pairs, with each upper opening 356*a* aligned vertically above a corresponding lower opening 356*b*. The openings 356 may be spaced such that they are aligned with the upper 372 and lower 374 rails, with the upper openings 356*a* generally aligned with the upper rail 372 and the lower openings 356*b* generally aligned with the lower rail 374. The attachment hooks 358 may include upper and lower attachment hooks 358*a*, 358*b*, and in one embodiment, the attachment hooks 358*a*, 358*b* each include a single hook 394, with the upper attachment hook 358*a* including a downward facing hook 394*a* and with the lower hooks 358*b* each including an upward facing hook 394*b*. The screen 330 is installed on the rail 370 with the hook 394*a* of the upper attachment hook 358*a* engaging the upper rail 372 and the hook 394*b* of the lower attachment hook 358*b* engaging the lower rail 374 to collectively retain the screen 330 on the rail 370 in a slidable manner. Similar to the screen 30, the screen 330 can be slid along the rail 370 from a closed position, shown in FIG. 23, to an open position wherein the screen 330 is slid along the rail 370 to a position in which the opening 312 of the cabinet 310** is accessible.

Other embodiments of the screen 30, 330 are contemplated wherein the screen can be positioned along a rail to function as an enclosure or door that can cover and uncover a variety of articles of furniture, such as bookcases, credenzas, and other cabinets of varying shapes and sizes with variations in track shapes and sizes. Attachment hooks 58, 358 having one or more of the hooks 94 can be used as desired for the particular application.

The above description is that of current embodiments of the disclosure herein. Various alterations and changes can be made without departing from the spirit and broader aspects of the disclosure as defined in the appended claims, which are to be interpreted in accordance with the principles of patent law including the doctrine of equivalents. This disclosure is presented for illustrative purposes and should not be interpreted as an exhaustive description of all embodiments of the disclosure or to limit the scope of the claims to the specific elements illustrated or described in connection with these embodiments. For example, and without limitation, any individual element(s) of the described disclosure may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A screen system for use with an article of furniture, the screen system comprising:

a screen having an upper edge and a lower edge defining a screen height therebetween, a left side edge and a right side edge defining a screen length therebetween, and an interior surface and an exterior surface defining a screen thickness therebetween, the screen configured to provide structure in the direction of the screen height, and having a degree of flexibility in the direction of the screen thickness greater than in the directed of the screen height, the screen including a plurality of attachment hooks projecting from the interior surface, the plurality of attachment hooks spaced apart along the screen length; and a rail configured to be affixed to the article of furniture, the rail having an upper rail edge and a lower rail edge, wherein the attachment hooks hook onto the rail to support the screen on the rail, the attachment hooks slidable along the rail to enable adjustment of the position of the screen along the rail in the direction of the screen length;

wherein the screen defines a plurality of openings extending through the screen thickness, the openings spaced apart along the screen length, and wherein the attachment hooks are formed separately from the screen, and each hook is inserted through a corresponding one of the openings such that it is positioned between the upper and lower edges of the screen, the screen extending outwardly beyond the hooks to provide a degree of privacy at least one of above and below the hooks;

wherein each attachment hook includes a base and a hook projecting from the base;

wherein at least one dimension of the base is greater than at least one dimension of the corresponding opening such that the base retains the attachment hook in the corresponding opening;

wherein at least one of the attachment hooks includes a pair of hooks extending from the base, the pair of hooks and the base forming a C-shape.

2. The screen system of claim 1 wherein one of the pair of hooks engages the upper rail edge and the other of the pair of hooks engages the lower rail edge.

3. A privacy screen system configured for use with a work surface, the work surface having at least one corner, the privacy screen system comprising:

a privacy screen having a main body with an upper edge and a lower edge defining a screen height therebetween, a left side edge and a right side edge defining a screen length therebetween, and an interior surface and an exterior surface defining a screen thickness therebetween, the screen having structure in the direction of the screen height, and having a degree of flexibility in the direction of the screen thickness, the screen defining a plurality of openings that are spaced apart along the screen length;

a plurality of attachment hooks positioned entirely between the upper edge and the lower edge of the screen body, each attachment hook having a base and a hook extending from the base, each attachment hook being inserted through an associated one of the openings such that the hook projects outwardly from the interior surface of the screen; and a rail configured to be affixed to a perimeter of the work surface and extending around the at least one corner of the work surface, the rail having an upper rail edge and a lower rail edge, the rail having opposite lateral ends;

wherein the privacy screen is slidably mounted to the rail between the lateral ends, with the hook portion of each attachment hook engaging at least one of the upper rail edge and the lower rail edge, wherein the position of the privacy screen is selectively adjustable toward one of the lateral ends by sliding the privacy screen along the rail with the hooks remaining engaged with, and sliding along, the at least one of the upper rail edge and the lower rail edge, wherein the flexibility of the screen enables sliding of the screen along the rail around the at least one corner of the work surface.

4. The privacy screen system of claim 3 wherein at least one dimension of the base is greater than at least one dimension of the associated opening such that the base retains the attachment hook in the corresponding opening.

5. The privacy screen system of claim 4 wherein the screen is formed from a PET material having a plurality of spaced apart hinge lines extending from the upper edge to the lower edge to provide the screen with the degree of flexibility.

6. The privacy screen system of claim 5 wherein the attachment hooks are formed from the same material.

7. The privacy screen system of claim 4 wherein the plurality of openings are positioned closer to one of the upper edge and the lower edge of the screen, such that the screen can be attached to the rail in a first orientation to be used as a privacy screen, or in a second orientation to be used as a modesty panel.

8. The privacy screen system of claim 4 wherein the rail includes an inner rail portion and an outer rail portion, the inner rail portion facing the work surface, the attachment hooks engaged with the outer rail portion to enable the attachment of one or more accessories to the inner rail portion.

9. The privacy screen system of claim 5 wherein the rail includes a mounting portion having a first end and a second end, the first end attached to one of the inner rail portion and the outer rail portion, and the second end adapted to attach to the work surface.

* * * * *